US010722896B2

(12) United States Patent
Giguere et al.

(10) Patent No.: US 10,722,896 B2
(45) Date of Patent: Jul. 28, 2020

(54) DEGERMINATOR

(71) Applicant: CEREAL ENTERPRISES, INC., Estes Park, CO (US)

(72) Inventors: Robert James Giguere, Overland Park, KS (US); James Michael Kramer, Glidden, IA (US); Steven Vondielingen, Carroll, IA (US)

(73) Assignee: CEREAL ENTERPRISES, INC., Estes Park, CO (US)

( * ) Notice: Subject to any disclaimer, the term of this patent is extended or adjusted under 35 U.S.C. 154(b) by 946 days.

(21) Appl. No.: 15/212,475

(22) Filed: Jul. 18, 2016

(65) Prior Publication Data

US 2017/0028404 A1 Feb. 2, 2017

Related U.S. Application Data

(60) Provisional application No. 62/198,442, filed on Jul. 29, 2015.

(51) Int. Cl.

| | |
|---|---|
| ***B02C 7/18*** | (2006.01) |
| ***B02B 3/02*** | (2006.01) |
| ***B02C 7/13*** | (2006.01) |

(52) U.S. Cl.

CPC ..... *B02C 7/184* (2013.01); *B02B 3/02* (2013.01); *B02C 7/13* (2013.01)

(58) Field of Classification Search

CPC ..... B02B 3/02; B02C 7/13; B02C 7/184

(Continued)

(56) References Cited

U.S. PATENT DOCUMENTS 416,371 A 12/1889 Millot
3,734,752 A * 5/1973 Headley ..... B02B 3/02 426/481

(Continued)

FOREIGN PATENT DOCUMENTS

DE 143767 * 6/1902
DE 143 767 C 8/1903

(Continued)

OTHER PUBLICATIONS

Theodore E. Stiver, Jr., "American Corn Milling Systems for De-Germed Products," *Bulletin-Association of Operative Millers*, pp. 2168-2179. Jun. 1955.

(Continued)

*Primary Examiner* — Dana Ross
*Assistant Examiner* — Joseph W Iskra
(74) *Attorney, Agent, or Firm* — Stinson LLP

(57) ABSTRACT

A degerminator having a base, a plate with a plurality of protrusions, and a clamp that engages the plate to removably secure the plate to the base. A degerminator having first and second plate assemblies and an enclosure that surrounds the first plate assembly. The second plate assembly has a seal that moves between deflated and inflated positions. The second plate assembly moves between a first position, in which it does not engage the enclosure, and a second position, in which the seal engages the enclosure when inflated. A degerminator having a frame, first and second plate assemblies, supports and guides each coupled to the frame or the second plate assembly, and actuators each coupled to the frame and the second plate assembly to move the second plate assembly relative to the first plate assembly. A removable wear ring may protect a side wall of the enclosure.

35 Claims, 26 Drawing Sheets

(58) Field of Classification Search
USPC ..... 99/600
See application file for complete search history.

(56) References Cited

U.S. PATENT DOCUMENTS

| | | | | |
|---|---|---|---|---|
| 4,189,503 | A | 2/1980 | Giguere | |
| 4,301,183 | A | 11/1981 | Giguere | |
| 4,365,546 | A | 12/1982 | Giguere | |
| 5,036,757 | A * | 8/1991 | Mueller | B02B 3/04 241/285.2 |
| 5,250,313 | A | 10/1993 | Giguere | |
| 8,113,447 | B1 | 2/2012 | Giguere | |
| 2008/0260902 | A1 * | 10/2008 | Van Houten | A23D 9/00 426/18 |

FOREIGN PATENT DOCUMENTS

| | | | |
|---|---|---|---|
| DE | 642 219 | C | 2/1937 |
| DE | 10 2010 050 793 | A1 | 4/2012 |
| ZA | 2002/04877 | A | 2/2003 |

OTHER PUBLICATIONS

European Patent Office, Extended European Search Report and Opinion, dated Dec. 7, 2016, 8 pages.

* cited by examiner

DEGERMINATOR

CROSS-REFERENCE TO RELATED APPLICATIONS

This application is based on and claims priority to U.S. Provisional Application Ser. No. 62/198,442, filed on Jul. 29, 2015, which is incorporated herein by reference in its entirety.

STATEMENT REGARDING FEDERALLY SPONSORED RESEARCH OR DEVELOPMENT

Not Applicable.

BACKGROUND OF THE INVENTION

1. Field of the Invention

This disclosure relates generally to grain milling and more particularly to a degerminator and a method for degerminating grain such as corn.

2. Description of Related Art

In a conventional corn milling process, corn is first introduced to a cleaning station wherein foreign materials such as stones, sticks, sand and foreign seeds are removed. The grain is then subjected to a water wash for removal of dirt and other foreign materials. Next, a tempering step is utilized to condition the grain for the subsequent grinding operations. The tempering procedure allows the whole kernel grain to absorb moisture and thereby magnifies the different grinding characteristics of the grain components. Since moisture is absorbed primarily through the germ tip of the grain, the tempering procedure normally lasts for about one and up to several hours depending upon the end product desired and the age and moisture content of the grain being processed. Tempering is achieved in a single or several steps over given time periods using simple water absorption or a combination of water and heat as hot water or steam.

The tempering process results in the relatively highly absorptive germ and bran becoming tough and pliable as these components take on water. On the other hand, the endosperm, which absorbs moisture much more slowly, will remain relatively unchanged although somewhat less brittle. This procedure also helps to commence parting of the endosperm from the germ and bran components.

The next step in the conventional process is to pass the tempered grain to a degerminator which breaks the whole kernel grain in a manner to achieve initial separation of germ, bran and endosperm. By far the most widely used type of degerminator is the Beall degerminator which is well known to those in the trade and which generally requires tempering of the grain to a moisture level of from 19% to 25%, depending on the degree of degermination and debranning sought. Also used at times is an impact type degerminator which generates less fines although the degree of germ separation is reduced in comparison to the Beall machine. In any case, the design of the degerminator is such that the germ is intended to be broken out from the endosperm to the extent possible without excessively grinding the germ component. Consideration is given to bran removal in this step depending on the final use of the end product. The goal of the degerminator, namely to remove the germ without grinding it unduly, is not actually reached with existing degerminators, and an additional problem is that low quality fines are produced which must be removed prior to further processing of the stock.

The degree of separation of germ from endosperm that is achieved with conventional degerminating machines is lacking somewhat and this incompleteness of the degermination causes many of the problems that are encountered in the overall milling process. In the Beall degerminator, which is used extensively in the United States, the grain kernels are rubbed more against one another than against the metal of the machine. As a consequence, even though relatively good separation of the germ is achieved, a large quantity of fines is generated and the fines are high in fat content since they contain much germ.

Impact type degerminators are used for specific purposes such as where finished products having high fat content are acceptable (table meal) and where smaller granulation of the finished products is involved (no large grits). The impact degerminators that have been used in the past generate fewer fines than the Beall degerminator and provide higher yields of recovered oil; however, the separation of the germ that is achieved with impact machines is poor and for this reason they have not been widely used. Most degerminators that have been proposed or used in the past break the germ, and the quality of the product is thus reduced in comparison to products in which the germ is in a whole condition.

Other types of degerminators, invented by R. James Giguere, are described in U.S. Pat. Nos. 4,189,503; 4,301,183; 4,365,546; and 5,250,313. The degerminators described in these patents crush corn kernels from their thin edges to separate the germ and endosperm without damaging the germ. While the degerminators described in these patents are revolutionary, there is room for improving the degerminators to maximize efficiency.

Generally the product out of the degerminator is separated into "tail" and "thru" streams, the former being relatively rich in endosperm and the latter being relatively rich in germ and bran. The two streams are then dried and cooled to reduce the moisture content to approximately 17%. Prior to commencing the grinding steps, the two degerminator streams are preferably placed on gravity tables (or aspirators) to achieve some further initial sorting out of germ and endosperm.

The roll grinders in the conventional milling process are set up in two series. One series is for the endosperm rich streams and the other series is for the germ rich streams. The concept utilized in each series of roller mills in the conventional milling process is to match particle size with individual roller mill characteristics. Thus, relatively large particles from the gravity tables (or aspirators) are directed to the first break and germ rollers respectively, according to particle size classification. These first rollers are characterized by relatively large corrugations with inherent coarse grinding characteristics. The smaller particles from the gravity tables are directed according to the successively finer series of rollers. For example, the stock going to the number one break roll may be that passing through a sieve with 3.5 wires per inch and over one with 5 wires per inch. The roller corrugation used for this stock is 6 per inch. Next, stock passing through a 5 wires per inch mesh but passing over one with 8 per inch is passed to a break roll with 8 corrugations per inch of roll circumference. The procedure is continued up to rolls with 20-24 corrugations per inch.

In general, rollers grinding the streams rich in endosperm have a higher roll speed differential than those grinding the germ rich streams, the reason being that the relatively fragile germ requires the gentler treatment afforded by a lower roll speed differential. This is the reason that two series of roller mills are employed.

Because of the different grinding characteristics of the components, as discussed above, the roller mills in each series will proceed to reduce the size of the endosperm relative to the size of the germ and bran. The mill stock that does not meet final product specification (excepting moisture) is continuously reclassified by size, aspirated to remove bran, and then passed to the next roller mill which is set up to receive the stock according to its primary component and particle size. The process is repeated over and over until the desired separating and sorting is accomplished.

The final steps in the conventional milling process are to dry the milled grain to a maximum moisture content of approximately 12% or to marketing and end use specifications, cool it, and aspirate off any remaining bran. The end product is then graded according to size into various component products.

BRIEF SUMMARY OF THE INVENTION

One embodiment of the present disclosure is directed toward a degerminator having a base, a plate with a plurality of protrusions, and a clamp that engages the plate and is coupled to the base to removably secure the plate to the base. The plate preferably has a first edge surface that engages the base, a second edge surface that engages the clamp, and a working surface that includes the protrusions. No mounting holes preferably extend through the working surface. A second plate is preferably clamped to a second base with a second clamp that engages the second plate and is coupled to the second base. The second plate has protrusions that face the protrusions of the plate. By securing the plate to the base with a clamp, no mounting holes are needed in the working surface of the plate, which means that the entire working surface may be configured for fracturing grain such as corn.

Another aspect of the present disclosure is directed to a degerminator having a first plate assembly, an enclosure that at least partially surrounds the first plate assembly, and a second plate assembly. The first plate assembly has a plurality of protrusions that face a plurality of protrusions of the second plate assembly. The second plate assembly has a seal with a channel that is configured to receive a fluid for moving the seal between a deflated position and an inflated position. The second plate assembly is movable between a first position, in which the second plate assembly does not engage the enclosure, and a second position, in which the seal engages the enclosure when the seal is in the inflated position. The first plate assembly and second plate assembly preferably each include a base, a plate, and a clamp as described above. The seal is preferably configured to remain in engagement with the enclosure while the second plate assembly moves relative to the first plate assembly so that adjustments may be made to the height of a gap between the second plate assembly and first plate assembly while the seal is still engaged.

In yet another aspect, the present disclosure includes a degerminator having a frame, a first plate assembly that is rotatably coupled to the frame, a second plate assembly, a plurality of supports each coupled to one of the frame and the second plate assembly, a plurality of guides each coupled to one of the frame and the second plate assembly, and a plurality of actuators each coupled to both the frame and the second plate assembly. The first plate assembly has a plurality of protrusions that face a plurality of protrusions of the second plate assembly. Each of the guides receives one of the supports. The actuators are operable to move the second plate assembly relative to the first plate assembly. The first plate assembly and second plate assembly preferably each include a base, a plate, and a clamp as described above. The second plate assembly preferably includes a seal that engages an enclosure of the frame as described above. The guides, supports, and actuators preferably enable the first plate assembly and second plate assembly to remain aligned in desired planes as the second plate assembly is moved relative to the first plate assembly, such that all portions of the second plate assembly move an equal distance at the same time and the second plate assembly does not rotate as it moves.

Another embodiment of the invention described herein is directed to a degerminator having a side wall surrounding a chamber, a plate that has a plurality of protrusions and that is at least partially positioned in the chamber, and a removable wear ring that is at least partially positioned between the side wall and the plate within the chamber. The wear ring preferably has an upper flange that is configured to be supported by a top of the side wall, and the wear ring is preferably configured to be moved vertically upward to remove it from the chamber. The wear ring preferably protects the side wall from abrasive grain particles that are fractured by the protrusions of the plate and that are expelled radially outward from the plate toward the side wall. The wear ring may be replaced when the grain particles have worn it down to an undesirable level.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
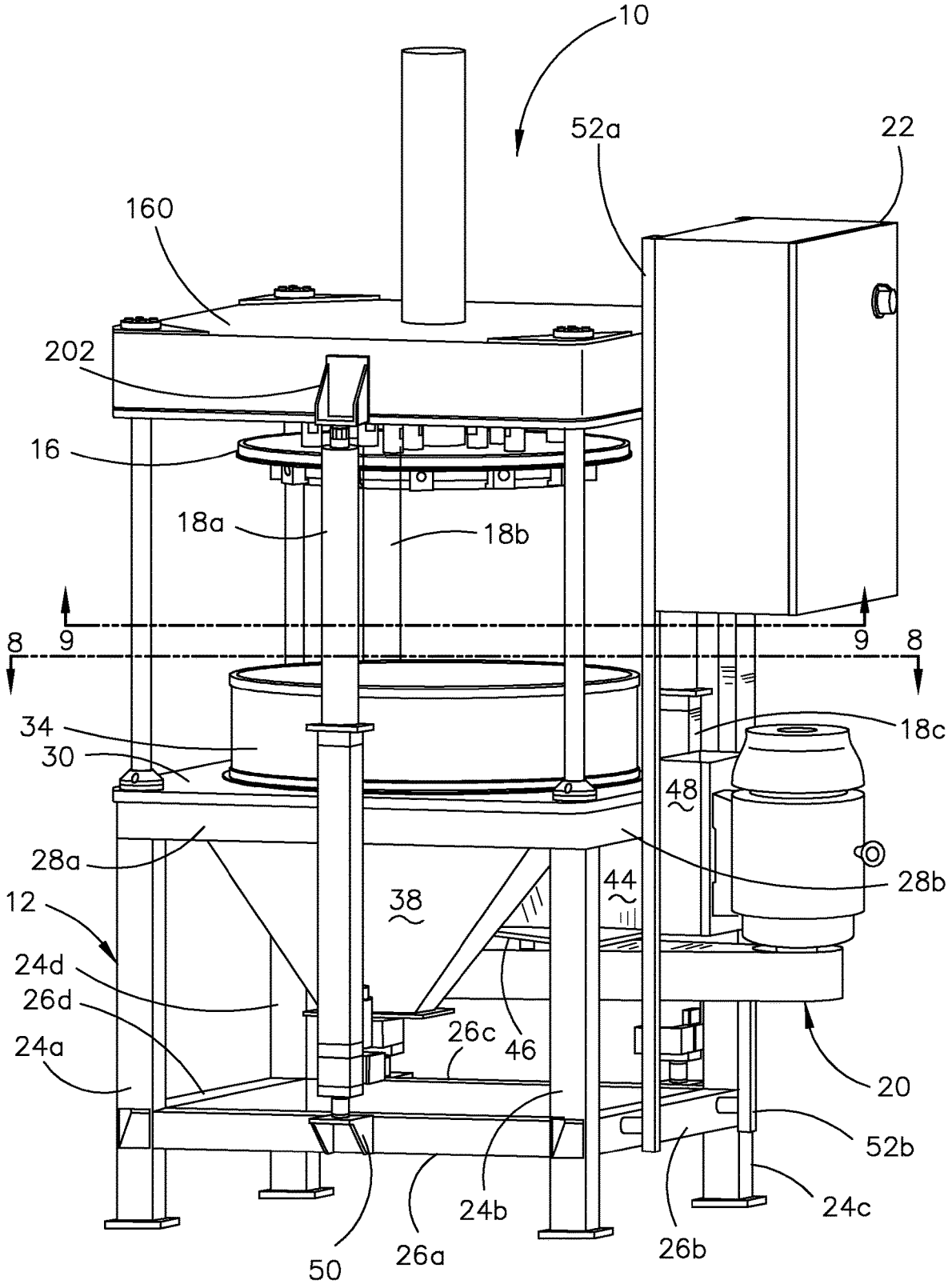
FIG. 1 is a perspective view of a degerminator in accordance with the present disclosure showing an upper plate assembly in a raised position.
Figure 8:
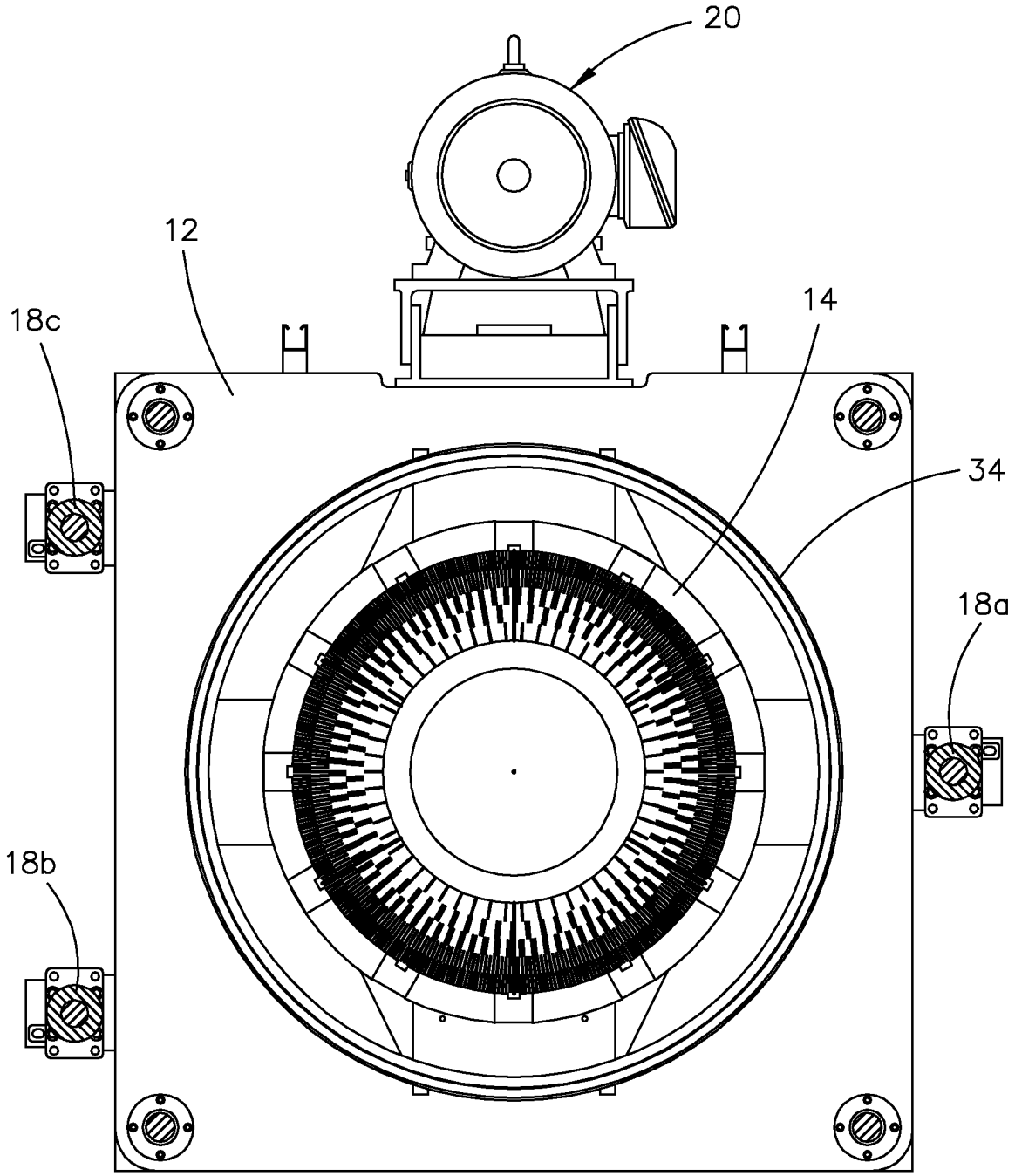
FIG. 8 is a cross-sectional view taken through the line 8-8 in FIG. 1.
Figure 9:
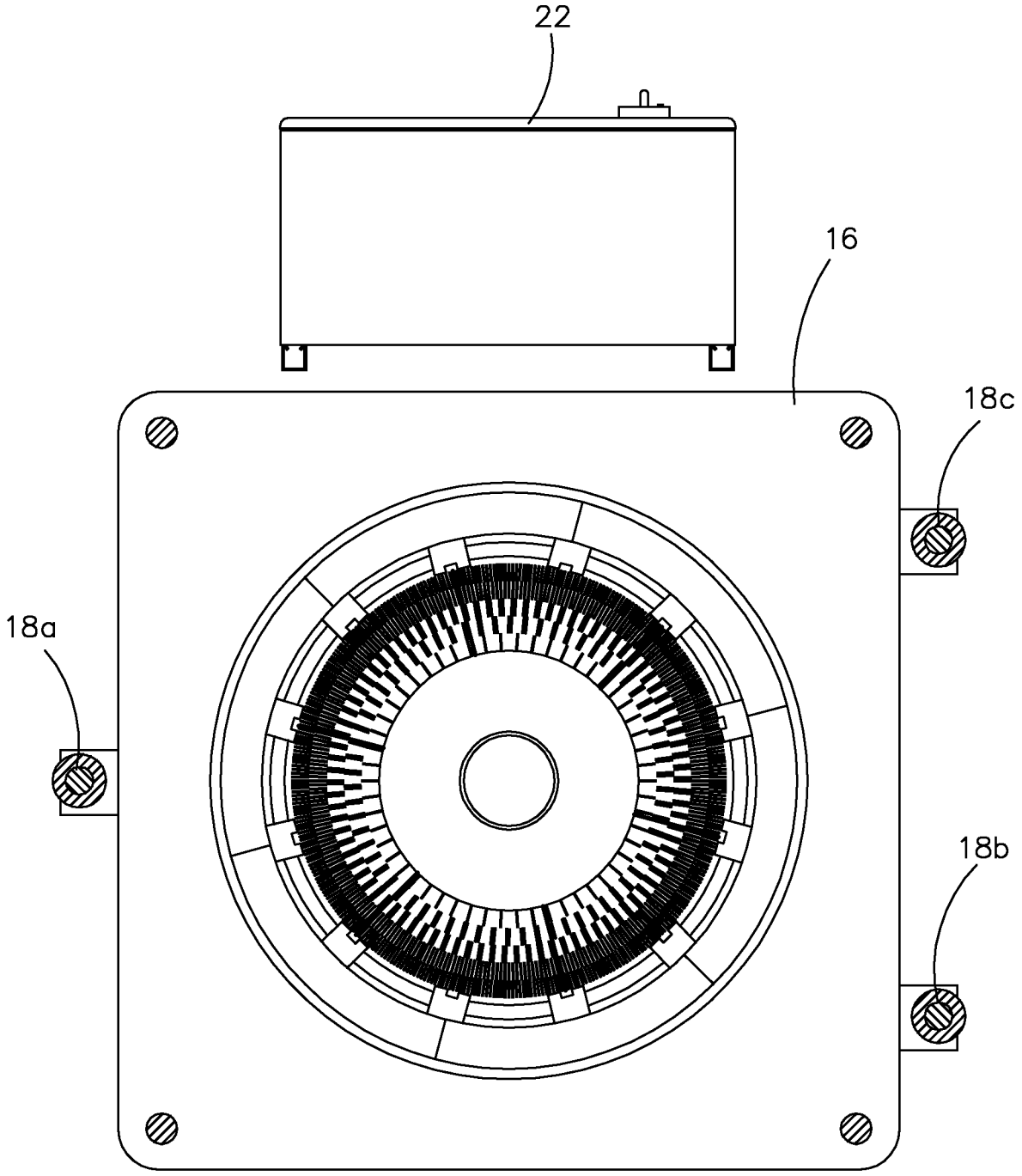
FIG. 9 is a cross-sectional view taken through the line 9-9 in FIG. 1.

A degerminator in accordance with the present disclosure is identified generally in FIG. 1 as 10. Degerminator 10 has a frame 12, a lower plate assembly 14 (FIG. 8) rotatably coupled to the frame 12, an upper plate assembly 16 coupled to the frame 12 above the lower plate assembly 14, linear actuators 18*a-c* coupled to both the frame 12 and the upper plate assembly 16, a drive assembly 20, and a control system 22.

Frame 12 provides a stable base to which the remaining components of degerminator 10 are mounted. Frame 12 includes vertical legs 24*a-d*, horizontal lower braces 26*a-d* each joined to a pair of adjacent legs 24*a-d*, horizontal upper braces 28*a-d* (FIGS. 1 and 3) each joined to and positioned on top of a pair of adjacent legs 24*a-d*, and an upper platform 30 joined to and positioned on top of upper braces 28*a-d*. Platform 30 has a central opening 32 shown in FIG. 10. A cylindrical side wall 34 is joined to platform 30 adjacent opening 32 and extends upward above platform 30. Side wall 34 forms an enclosure that surrounds a chamber 36 (FIG. 10) within which is positioned at least a portion of lower plate assembly 14. A pair of exit chutes 38 and 40 are joined to an underside of platform 30 and extend downward from platform 30. Chutes 38 and 40 are joined to platform 30 adjacent opening 32. Each of chutes 38 and 40 has a hollow interior that is in fluid communication with chamber 36.

Figure 4:
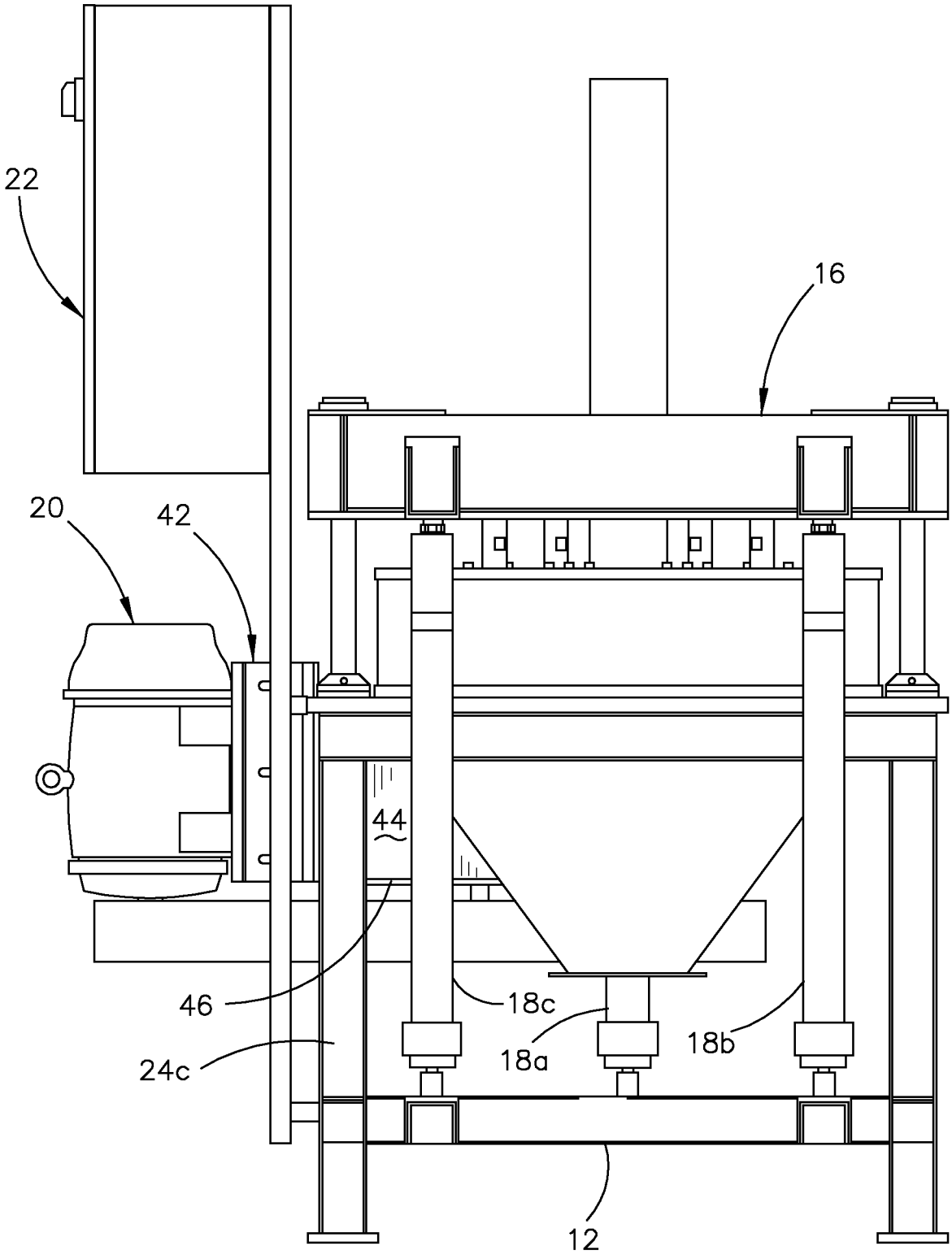
FIG. 4 is a side elevational view of the degerminator of FIG. 1.
Figure 5:
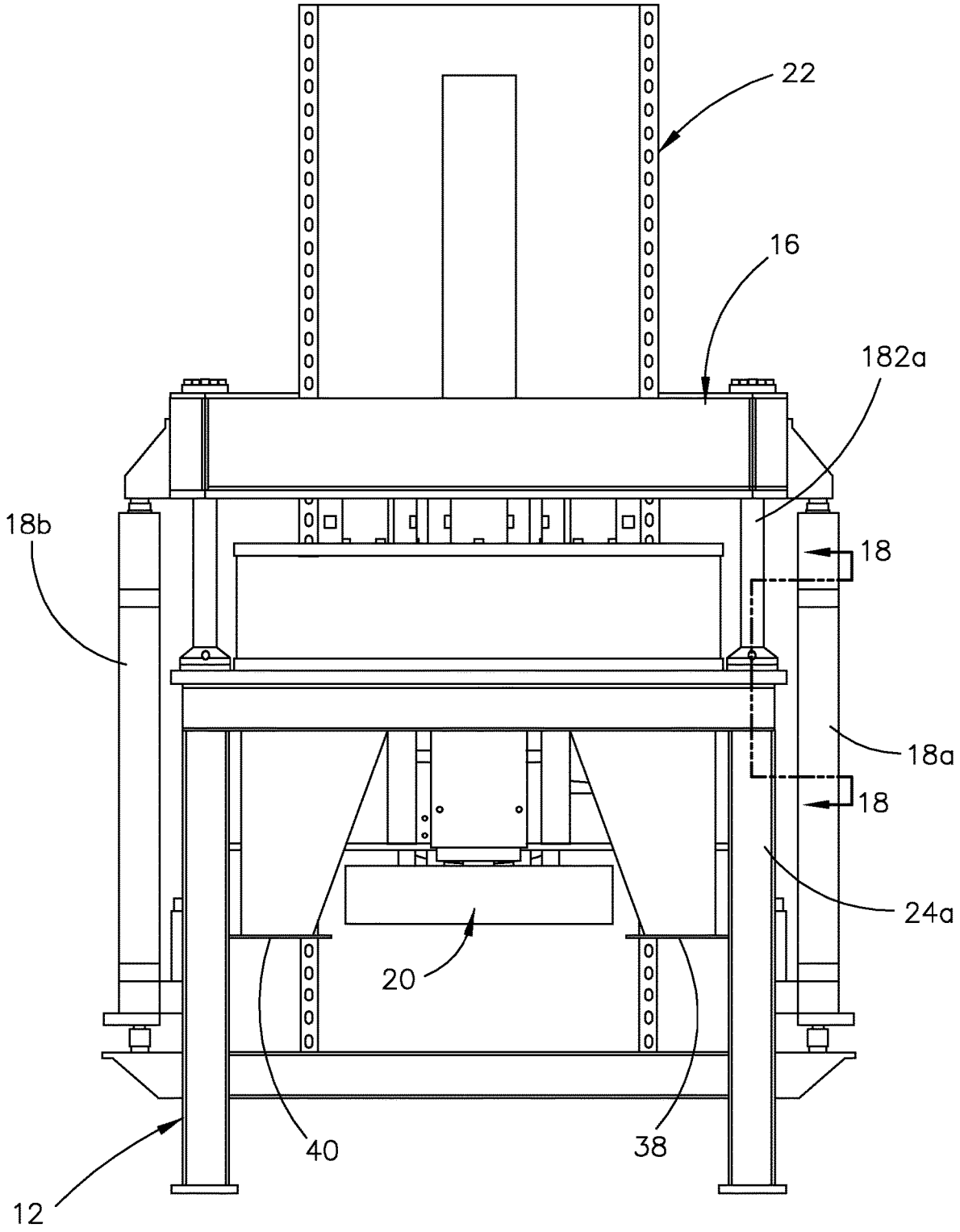
FIG. 5 is a rear elevational view of the degerminator of FIG. 1.

Frame 12 includes a drive assembly mount 42 (FIG. 4) that includes a box 44 mounted to an underside of platform 30, a triangular plate 46 mounted to an underside of box 44 and to legs 24*b-c* (as shown in FIGS. 1 and 4), and a motor mount 48 mounted to box 44. Motor mount 48 is preferably configured for mounting a number of different motors to frame 12 allowing an operator to switch to a larger or smaller motor if desired.

Frame 12 also includes three lower actuator mounts, one of which is identified as 50 in FIG. 1. Lower actuator mount 50 is joined to lower brace 26*a* and includes structure configured to mount a lower end of actuator 18*a* to frame 12. Actuators 18*b* and 18*c* are mounted to frame 12 in a similar manner. Frame 12 includes a pair of vertical struts 52*a-b* each mounted to lower brace 26*b* and platform 30. Control system 22 is mounted to struts 52*a-b*.

Figure 10:
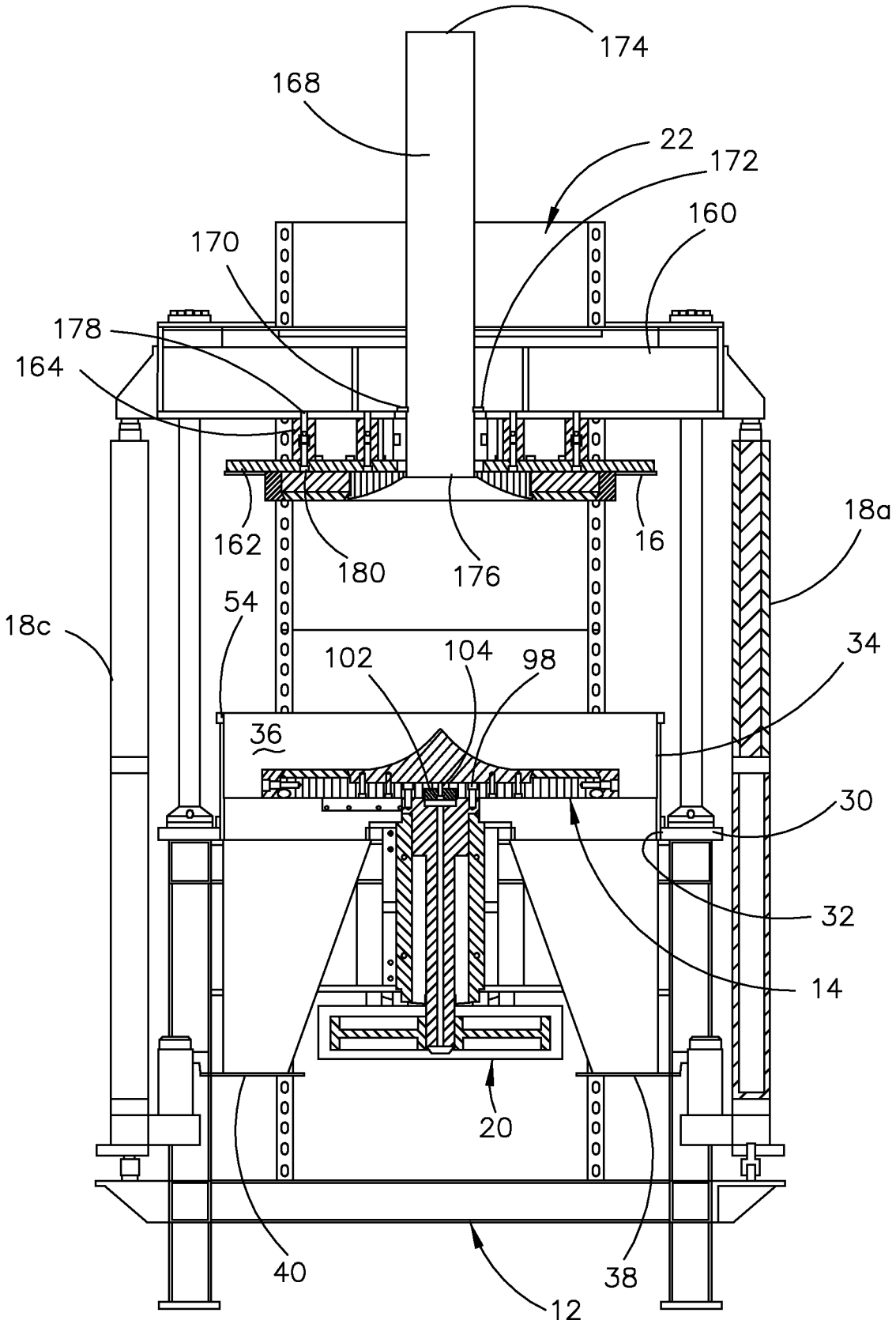
FIG. 10 is a cross-sectional view taken through the line 10-10 in FIG. 6.
Figure 13:
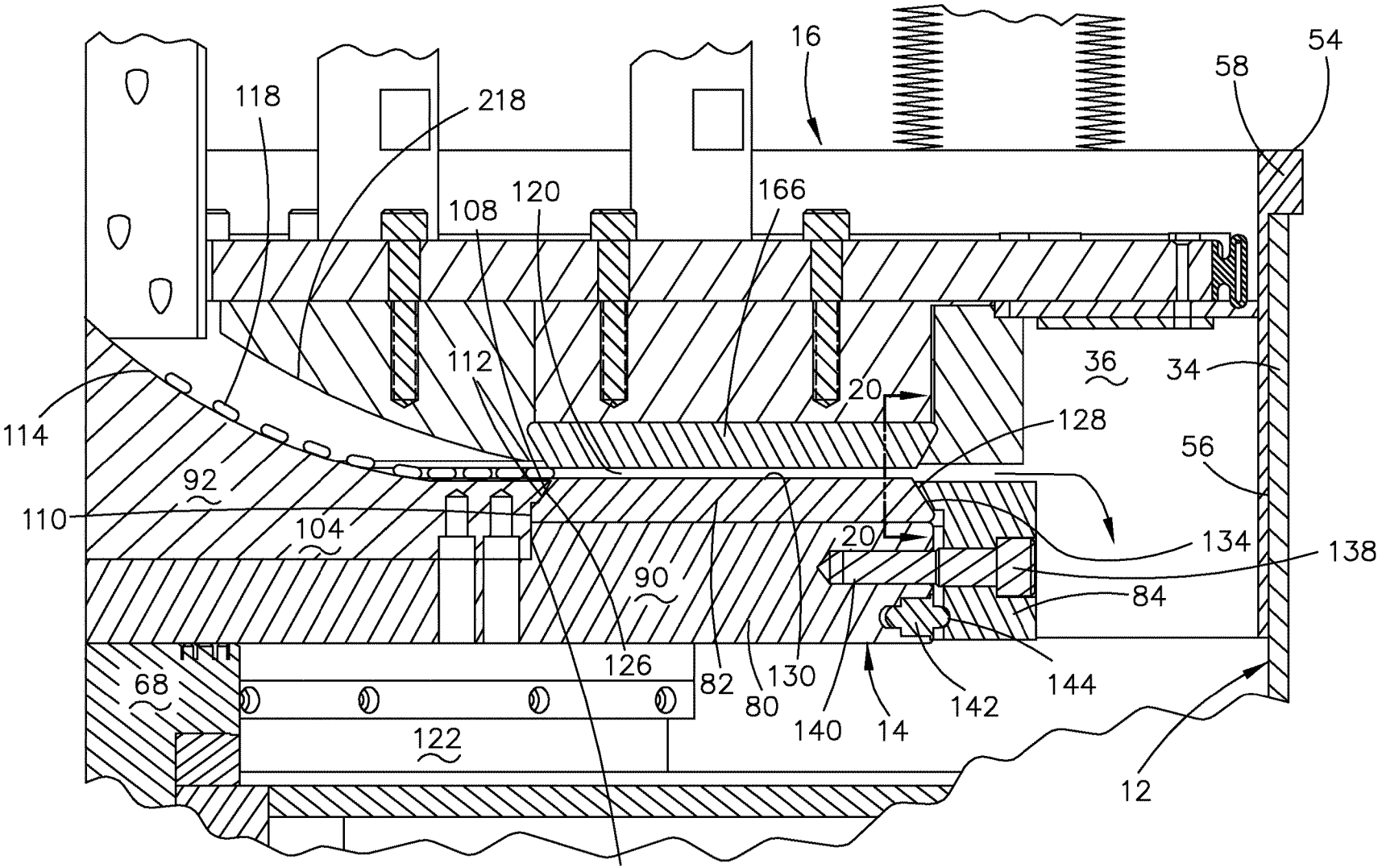
FIG. 13 is a cross-sectional view of a portion of the upper plate assembly in the lowered position and a portion of the lower plate assembly.

A wear ring 54, shown in FIGS. 10 and 13, is positioned within chamber 36 to protect side wall 34 of frame 12 from abrasive particles produced during degermination of a grain such as corn kernels. Wear ring 54 includes a cylindrical wall 56 (FIG. 13) having a diameter that is slightly less than the interior diameter of side wall 34 so that wall 56 is positioned within side wall 34. Wear ring 54 has an upper flange 58 that extends radially outward from the upper edge of wall 56. Flange 58 has a diameter that is larger than the diameter of side wall 34 so that flange 58 can rest on the top of side wall 34. If wear ring 54 needs to be replaced, it may be lifted off of side wall 34 and replaced with a new wear ring 54.

Figure 11:
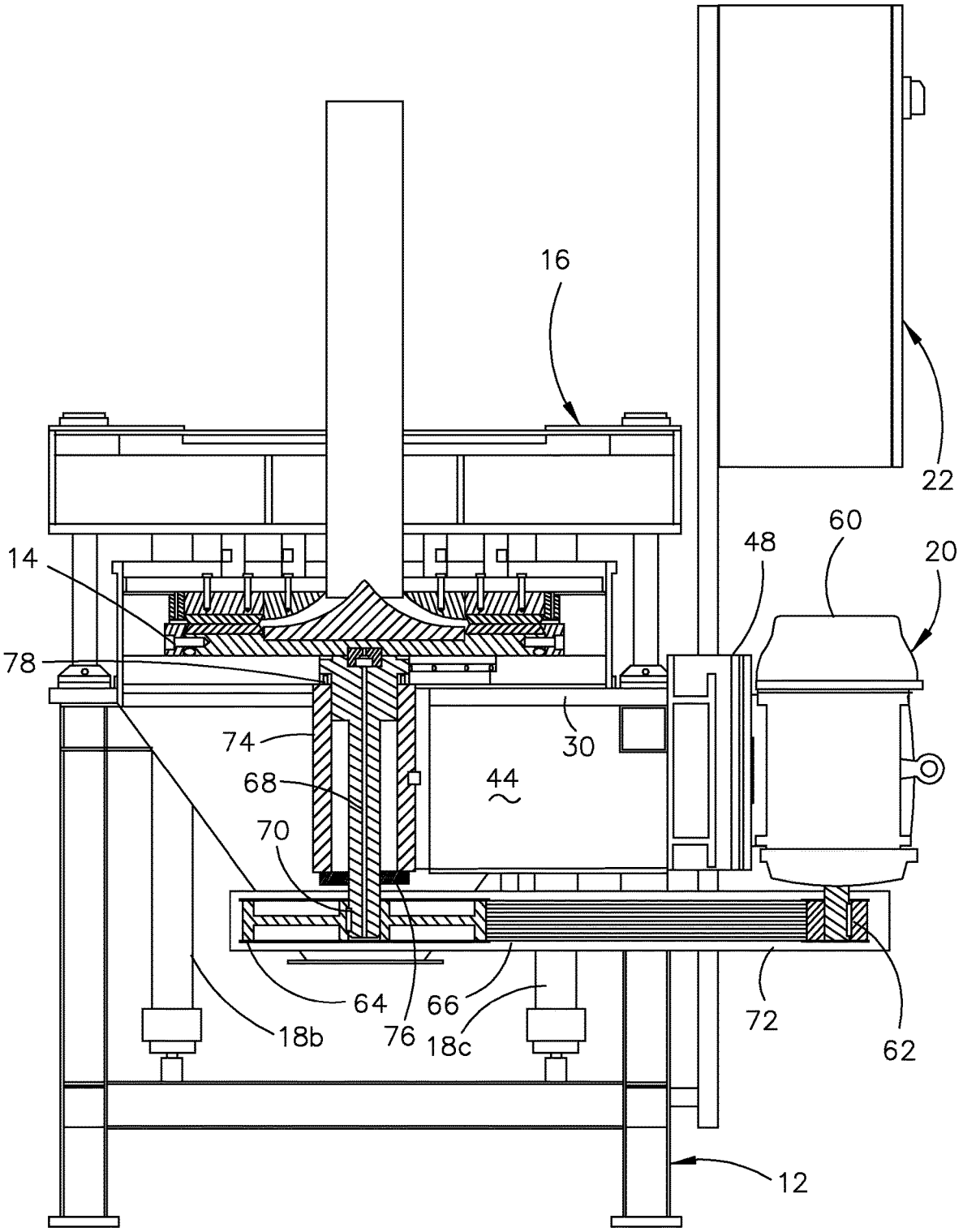
FIG. 11 is a cross-sectional view taken through the line 11-11 in FIG. 6.

Drive assembly 20, shown in FIG. 11, includes a motor 60 mounted to motor mount 48, a pulley 62 mounted to a shaft of motor 60, a pulley 64, a number of belts, one of which is identified as 66, extending around pulleys 62 and 64, and a spindle 68 mounted to pulley 64 with a key 70. A shroud 72 encloses pulleys 62 and 64 and belts 66 for protection. A spindle housing 74 encloses a portion of spindle 68 between shroud 72 and platform 30. Spindle housing 74 is joined to platform 30 and box 44. Spindle 68 rotates within bearings 76 and 78. Spindle 68 includes a lower portion mounted to pulley 64 that has a smaller diameter than an upper portion of spindle 68. The upper portion of spindle 68 is mounted to lower plate assembly 14 with bolts (not shown) that extend downward through a portion of lower plate assembly 14 into spindle 68, as described in more detail below. Motor 60 is preferably an electric motor that is replaceable and may have any desirable power output. Spindle housing 74 is preferably sealed against spindle 68 to prevent contaminants from entering the spindle housing 74. Degerminator 10 also preferably includes an air compressor (not shown) that pressurizes the interior of spindle housing 74 to prevent contaminants and grain particles from entering spindle housing 74 and damaging spindle 68.

Figure 12:
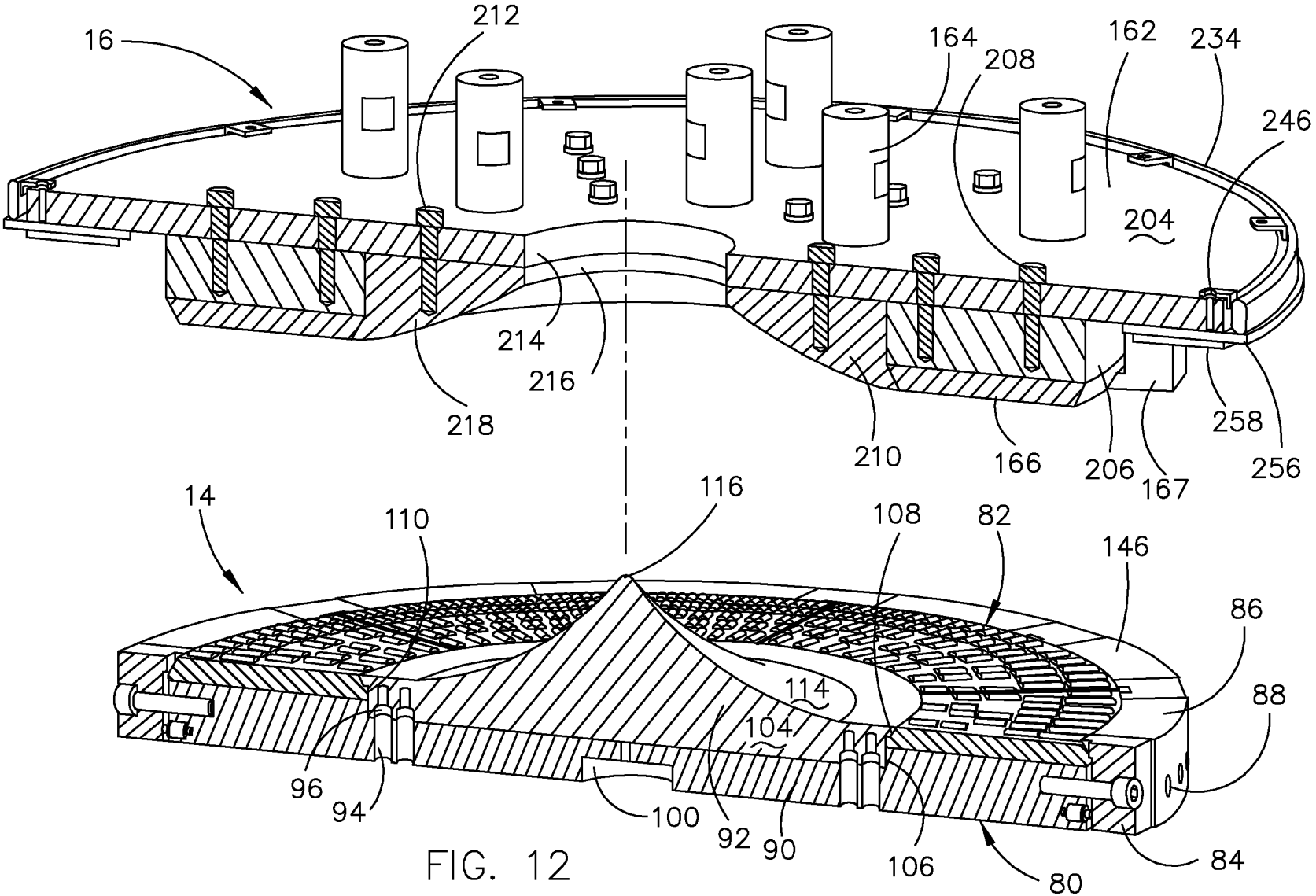
FIG. 12 is a cross-sectional perspective view of the upper plate assembly and a lower plate assembly of the degerminator of FIG. 1.
Figure 12A:
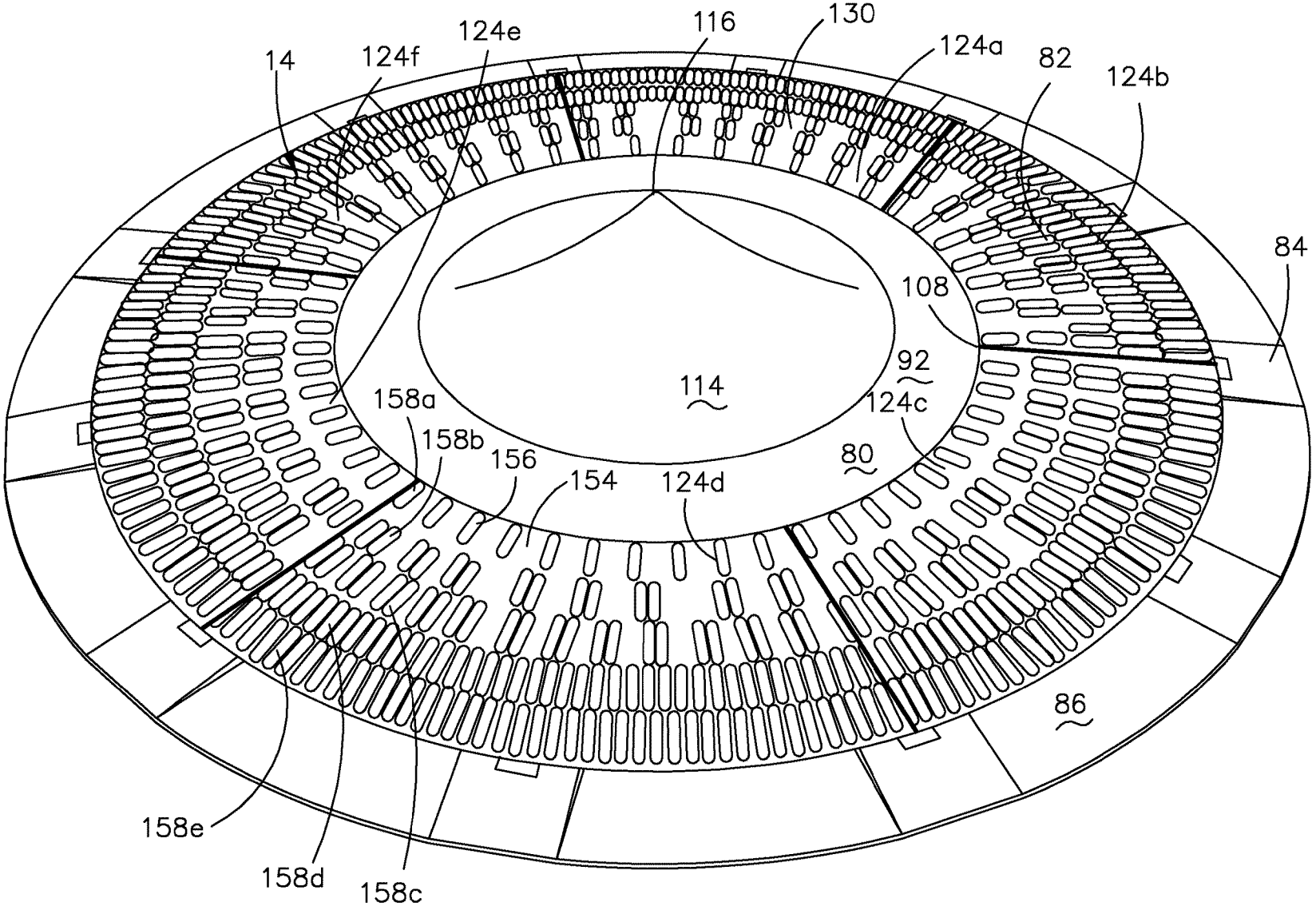
FIG. 12A is a perspective view of the lower plate assembly shown in FIG. 12.

Lower plate assembly 14, shown in FIGS. 12 and 12A, includes a lower base 80 and an annular lower plate 82 that is clamped to lower base 80 with a plurality of clamps, one of which shown in cross-section in FIG. 12 is identified as 84. Spacers, one of which is identified as 86, are positioned between adjacent clamps 84 and joined to lower base 80 with fasteners, one of which is identified as 88 in FIG. 12.

Lower base 80 includes a generally circular lower section 90 and a conical upper section 92 that is joined to lower section 90 via bolts (not shown) threaded in aligned openings, one pair of which is identified as 94 and 96. Lower section 90 is joined to spindle 68 with bolts, one of which is identified in FIG. 10 as 98, passing through lower section 90 into an opening in an upper surface of spindle 68. Lower section 90 includes a circular recess 100 (FIG. 12) that receives a circular key 102 (FIG. 10). Circular key 102 is joined to lower section 90 with a bolt 104. Circular key 102 protrudes downward from lower section 90 and is received within a recess of spindle 68 to align lower plate assembly 14 and spindle 68. Motor 60 drives spindle 68 to rotate lower plate assembly 14 around a generally vertical axis that is aligned with spindle 68.

As shown in FIG. 13, upper section 92 includes a generally circular base 104 that is positioned within a circular recess 106 formed in lower section 90. An upper portion 108 of circular base 104 extends radially outward from the circular recess 106 in lower section 90. Upper portion 108 is spaced above lower section 90 to form an annular recess 110 positioned between the lower section 90 and upper section 92. Upper portion 108 has an outer edge surface 112 that is angled from vertical. Outer edge surface 112 angles radially inward toward a center of lower plate assembly 14 as outer edge surface 112 moves downward toward recess 110, such that an upper portion of outer edge surface 112 extends radially outward farther than a lower portion of outer edge surface 112.

Figure 26:
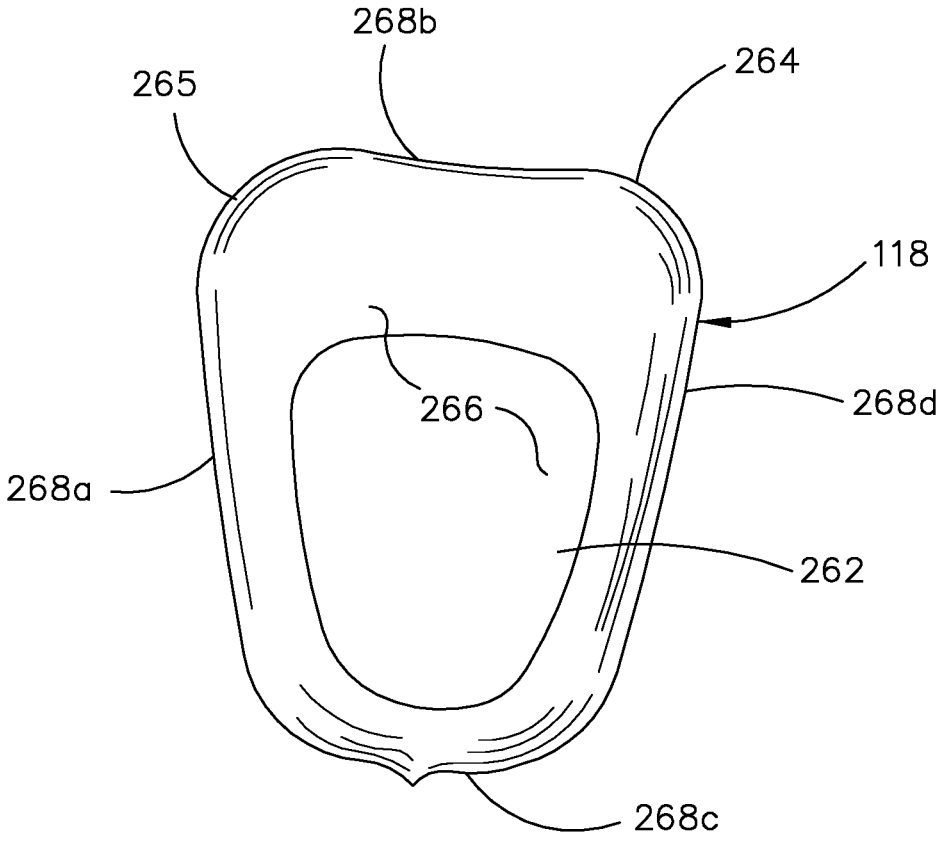
FIG. 26 is a top plan view of the corn kernel shown in FIG. 25.

Upper section 92 includes a conical outer surface 114 integral with and extending upward from circular base 104. Conical outer surface 114 extends upward to a tip 116 (FIG. 12) that is centered on a generally vertical rotational axis of lower plate assembly 14. Conical outer surface 114 is preferably shaped to engage and direct corn kernels, one of which is identified as 118 in FIG. 13, to a gap 120 between lower plate assembly 14 and upper plate assembly 16, as described in more detail below, such that the corn kernels are laying on their side 266 (FIG. 26). A vane 122 is joined to lower section 90 and extends downward from lower section 90. Vane 122 directs air and corn particles toward side wall 34 and away from spindle 68 as lower plate assembly 14 rotates.

As shown in FIG. 12A, lower plate 82 is divided into six sections 124*a-f*. Referring to FIG. 13, lower plate 82 is annular with an inner edge surface 126, an outer edge surface 128, and a working surface 130 extending between the inner edge surface 126 and the outer edge surface 128. A portion of the inner edge surface 126 is received within recess 110. Inner edge surface 126 mates with outer edge surface 112 of lower base 80 in a non-vertical plane. Inner edge surface 126 angles radially inward toward a center of lower plate assembly 14 as inner edge surface 126 moves downward toward recess 110, such that an upper portion of inner edge surface 126 is positioned radially outward farther than a lower portion of inner edge surface 126.

Figure 16:
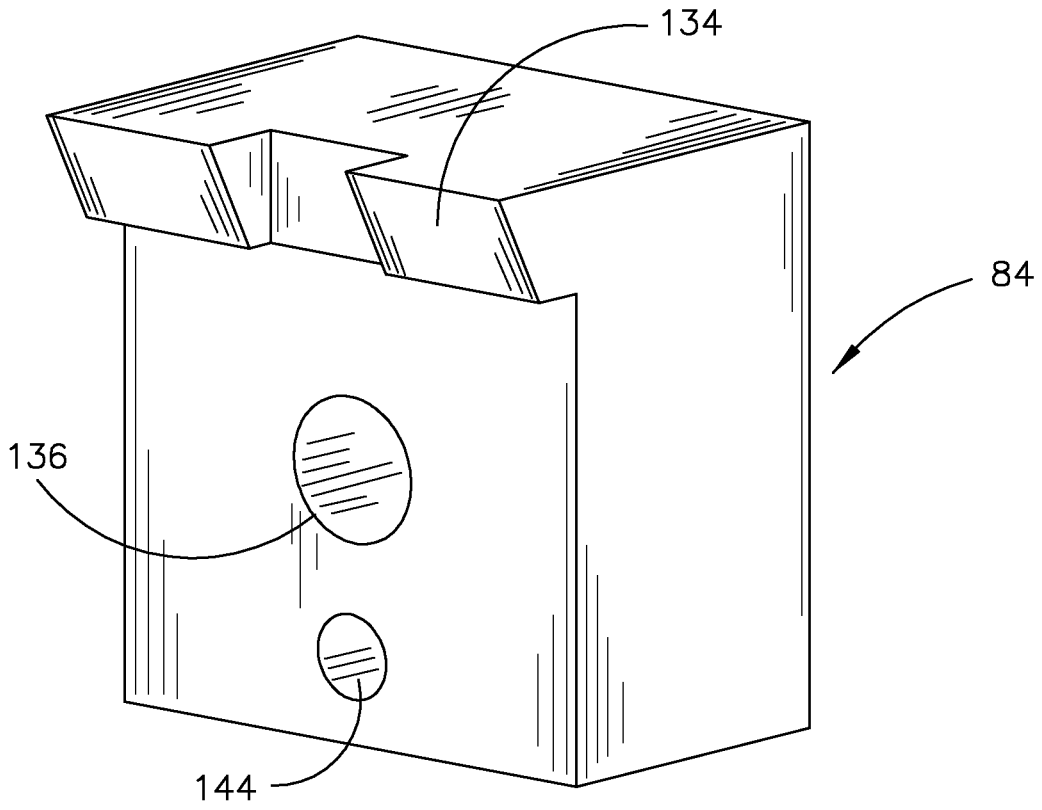
FIG. 16 is a perspective view of a clamp of the lower plate assembly.

Outer edge surface 128 angles radially outward away from a center of lower plate assembly 14 as outer edge surface 128 moves downward toward lower base 80. An angled surface 134 of clamp 84 is configured to mate with outer edge surface 128 in a non-vertical plane. Angled surface 134 angles radially outward away from a center of lower plate assembly 14 as angled surface 134 moves downward toward lower base 80. Clamp 84 has an opening 136 (FIG. 16) that receives a bolt 138 (FIG. 13), which threads into an opening 140 within lower base 80 to secure lower plate 82 to lower base 80. As bolt 138 is tightened clamp 84 engages lower plate 82 to secure lower plate 82 between the outer edge surface 112 of lower base 80 and the angled surface 134 of clamp 84. A portion of inner edge surface 126 is positioned within recess 110 to prevent lower plate 82 from raising when clamped to lower base 80. Mating angled surfaces 112 and 126 and mating angled surfaces 128 and 134 also prevent lower plate 82 from raising when clamped to lower base 80. A detent 142 threads into lower base 80 and protrudes outward from lower base 80. Detent 142 is received within a depression 144 in clamp 84 for positioning clamp 84 as it is tightened to lower base 80.

As shown in FIG. 12A, one of clamps 84 is positioned in the center of each of the sections 124*a-f* of lower plate 82, and one of clamps 84 is positioned where adjacent sections 124*a-f* meet. Each of clamps 84 that is positioned where adjacent sections 124*a-f* meet engages both of the adjacent sections 124*a-f* to clamp both of the adjacent sections 124*a-f* to lower base 80. Clamping each of the sections 124*a-f* to lower base 80 in three locations in the manner described herein ensures that the working surfaces 130 of the sections 124*a-f* are aligned in the same plane with each other and with the outer surface of upper section 92 of lower base 80 so that corn kernels 118 sliding down upper section 92 enter the gap 120 (FIG. 13) and engage working surface 130 without obstruction. Even if the working surfaces 130 of sections 124*a-f* are slightly warped or bowed due to manufacturing imperfection, clamps 84 secure the sections 124*a-f* to lower base 80 in a manner that flexes the sections 124*a-f* to ensure that the working surface 130 presented by all of the sections 124*a-f* in combination is aligned and continuous. Thus, there are preferably no ridges in working surface 130 at the locations where sections 124*a-f* meet. Working surface 130 may be planar and horizontal or shaped as part of a conical surface that is angled upwardly or downwardly as it extends radially outward. Clamps 84 may be removed to replace sections 124*a-f* of lower plate 82 that are worn or to replace sections 124*a-f* with sections having a larger or smaller diameter, as described in more detail below with respect to FIG. 19.

Clamps 84 are designed to secure lower plate 82 to lower base 80 such that there are no mounting holes in lower plate 82 that extend through the working surface 130 of lower plate 82. Therefore, the entire working surface 130 is available for configuration to engage and fracture corn kernels 118, and there are no unwanted holes or depressions in the working surface 130 to trap corn particles or disrupt the fracturing process. Preferably, and as shown in the drawings, there are no mounting holes formed in any surface of lower plate 82.

Figure 17:
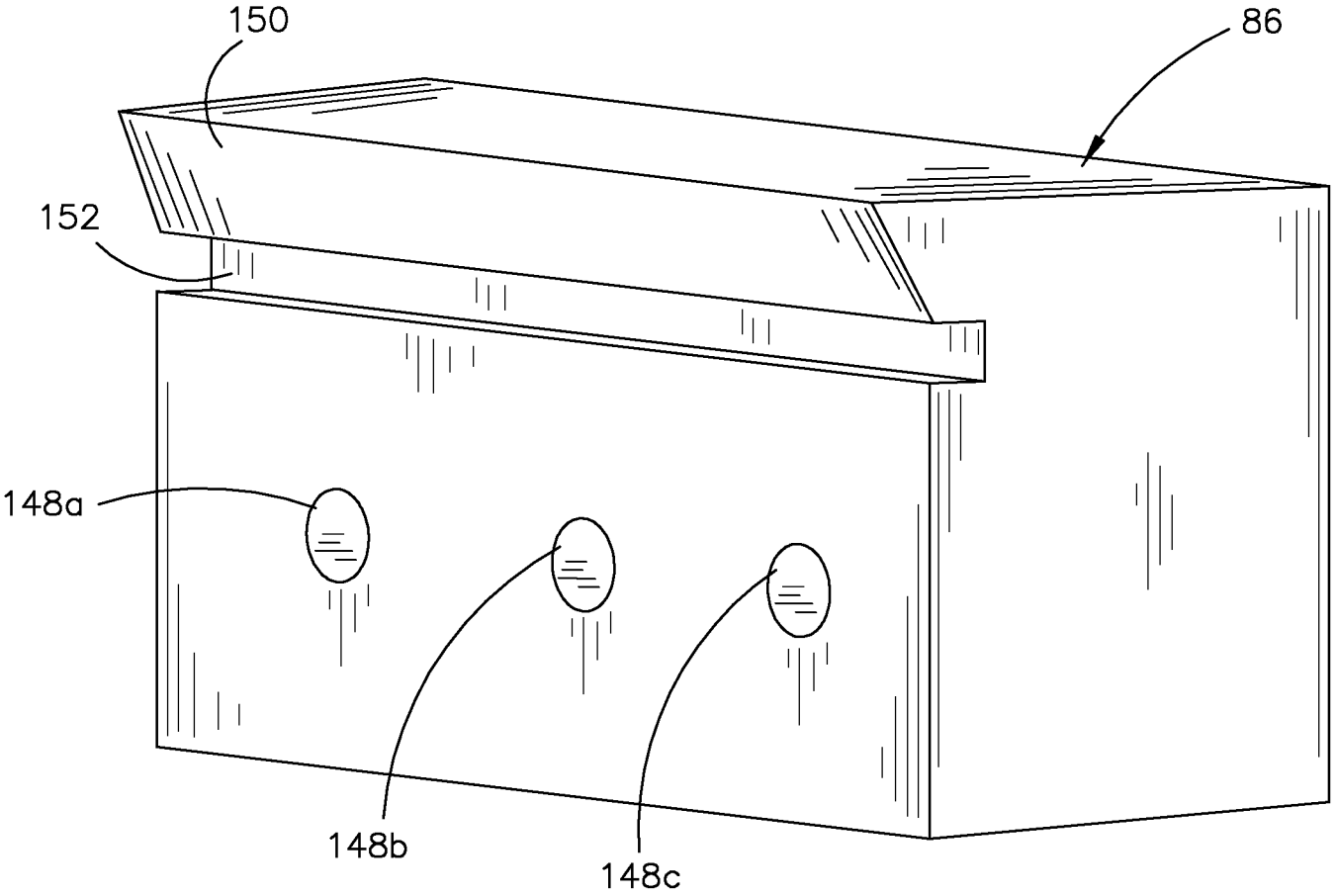
FIG. 17 is a perspective view of a spacer of the lower plate assembly.

Spacers 86 are positioned between adjacent clamps 84, as shown in FIG. 12. The spacers 86 are designed to fill the gap between adjacent clamps 84. The clamps 84 and spacers 86 present a generally planar annular upper surface 146 over which corn particles pass as they move radially outward toward side wall 34 (FIG. 13). Spacer 86 is shown in more detail in FIG. 17. Spacer 86 includes three openings 148*a-c* each receiving a bolt, one shown as 88 in FIG. 12, to secure spacer 86 to lower base 80. Spacer 86 includes an angled surface 150 that engages the outer edge surface 128 (FIG. 13) of lower plate 82. A groove 152 positioned beneath angled surface 150 is formed to provide clearance for any portion of lower plate 82 extending radially outward from lower base 80.

Referring to FIG. 12A, working surface 130 includes a base 154 and a plurality of corrugations, one of which is identified as 156, extending outward from base 154. Base 154 need not necessarily be horizontal. For example, base 154 may be shaped as part of a conical surface that is angled upwardly or downwardly as it extends radially outward. It is within the scope of the invention for the corrugations 156 to have any desired shape and be arranged in any desired manner on working surface 130. Further, the corrugations 156 may be any type of protrusion besides a corrugation extending outward from working surface 130. Corrugations 156 are arranged in five rows 158*a-e*, each successive row 158*a-e* positioned radially outward from the preceding row 158*a-e*. In the first row 158*a*, there are gaps positioned between adjacent corrugations 156, each gap being approximately the size of two or three corrugations 156. In the second row 158*b*, the corrugations 156 are arranged in pairs with gaps positioned between adjacent pairs, each gap being approximately the size of two or three corrugations 156. The third row 158*c* has corrugations 156 arranged in pairs with gaps positioned between adjacent pairs, each gap being approximately the size of one corrugation 156. The fourth and fifth rows 158*d-e* are filled with corrugations 156 having no appreciable gap between adjacent corrugations 156. The functionality of the corrugations 156 is described in more detail below with respect to FIG. 20.

Figure 2:
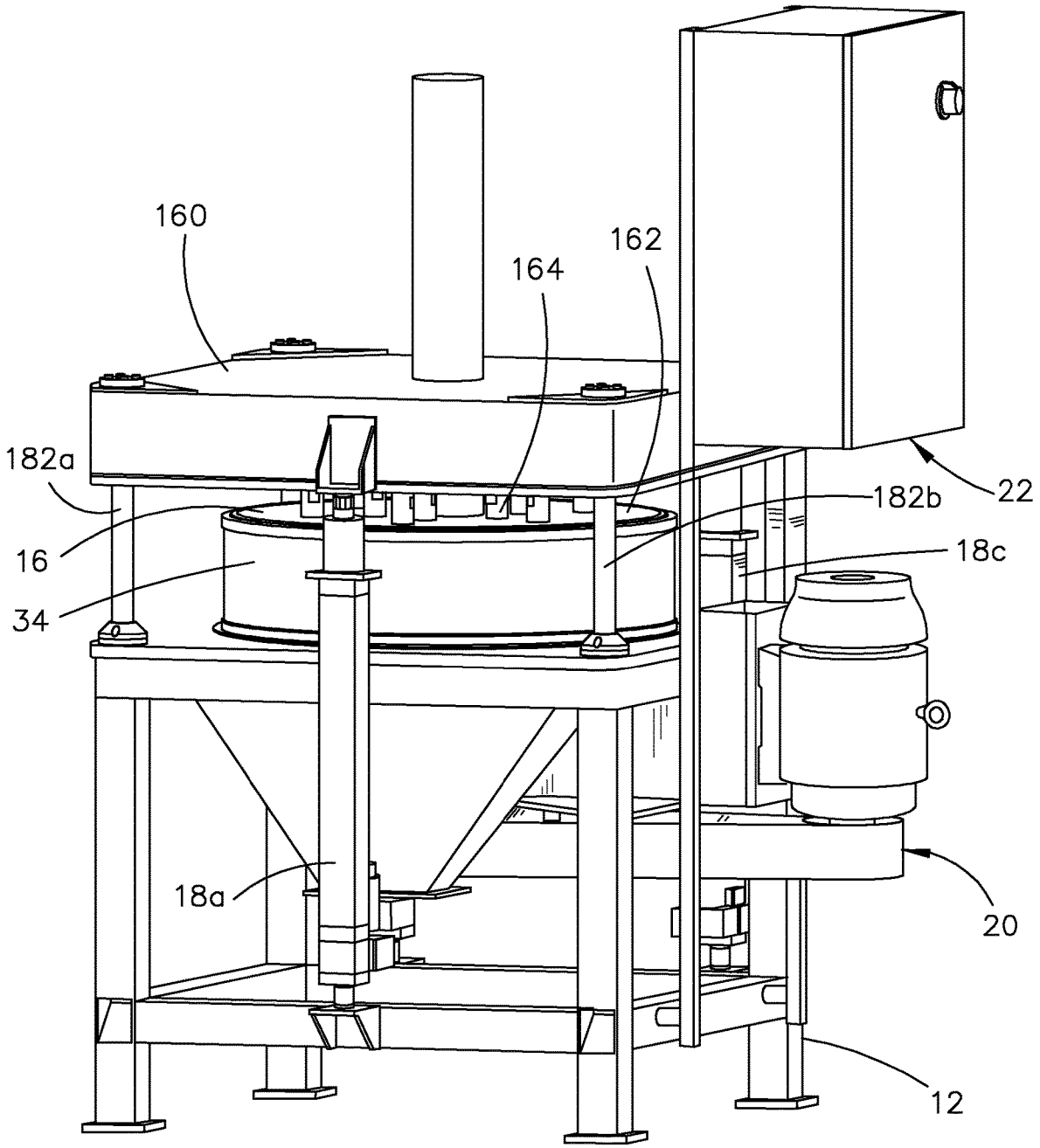
FIG. 2 is a perspective view of the degerminator of FIG. 1 showing the upper plate assembly in a lowered position.

Upper plate assembly 16 includes a box frame 160, shown in FIG. 2, an upper base 162 mounted to the box frame 160 with a plurality of spacers, one of which is identified as 164, and an upper plate 166 (FIG. 12) mounted to upper base 162 with a plurality of clamps, one of which is identified as 167. Box frame 160 is preferably formed from a plurality of plates welded or otherwise joined together to form a rigid assembly. A hollow inlet tube 168 is mounted to a portion of box frame 160, as shown in FIG. 10. Inlet tube 168 includes a flange 170 that mounts to box frame 160 with bolts, one of which is identified as 172. Inlet tube 168 has an inlet opening 174 positioned above box frame 160 and extending through box frame 160 to an exit opening 176 that is generally adjacent upper base 162. Inlet tube 168 is configured to receive corn kernels through inlet opening 174 and deliver the corn kernels through exit opening 176.

Each of spacers 164 is mounted to box frame 160 with a bolt, one of which is identified as 178 in FIG. 10, that extends downward through box frame 160 into the spacer 164. Each of spacers 164 is mounted to upper base 162 with a bolt, one of which is identified as 180 in FIG. 10, that extends upward through a portion of upper base 162 into the spacer 164. In this manner, the spacers 164 mount the upper base 162 to box frame 160.

Figure 3:
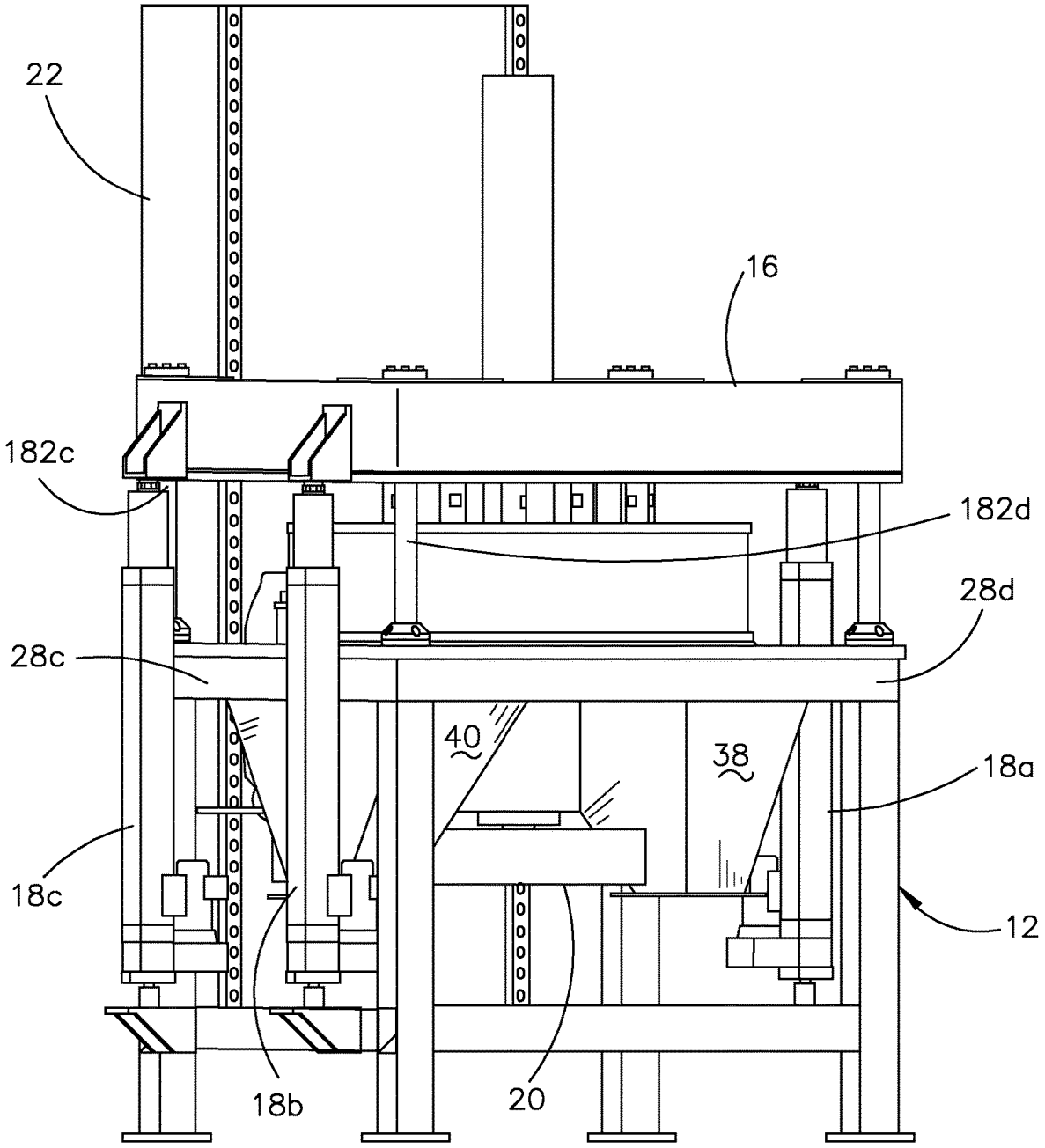
FIG. 3 is a rear perspective view of the degerminator of FIG. 1.
Figure 6:
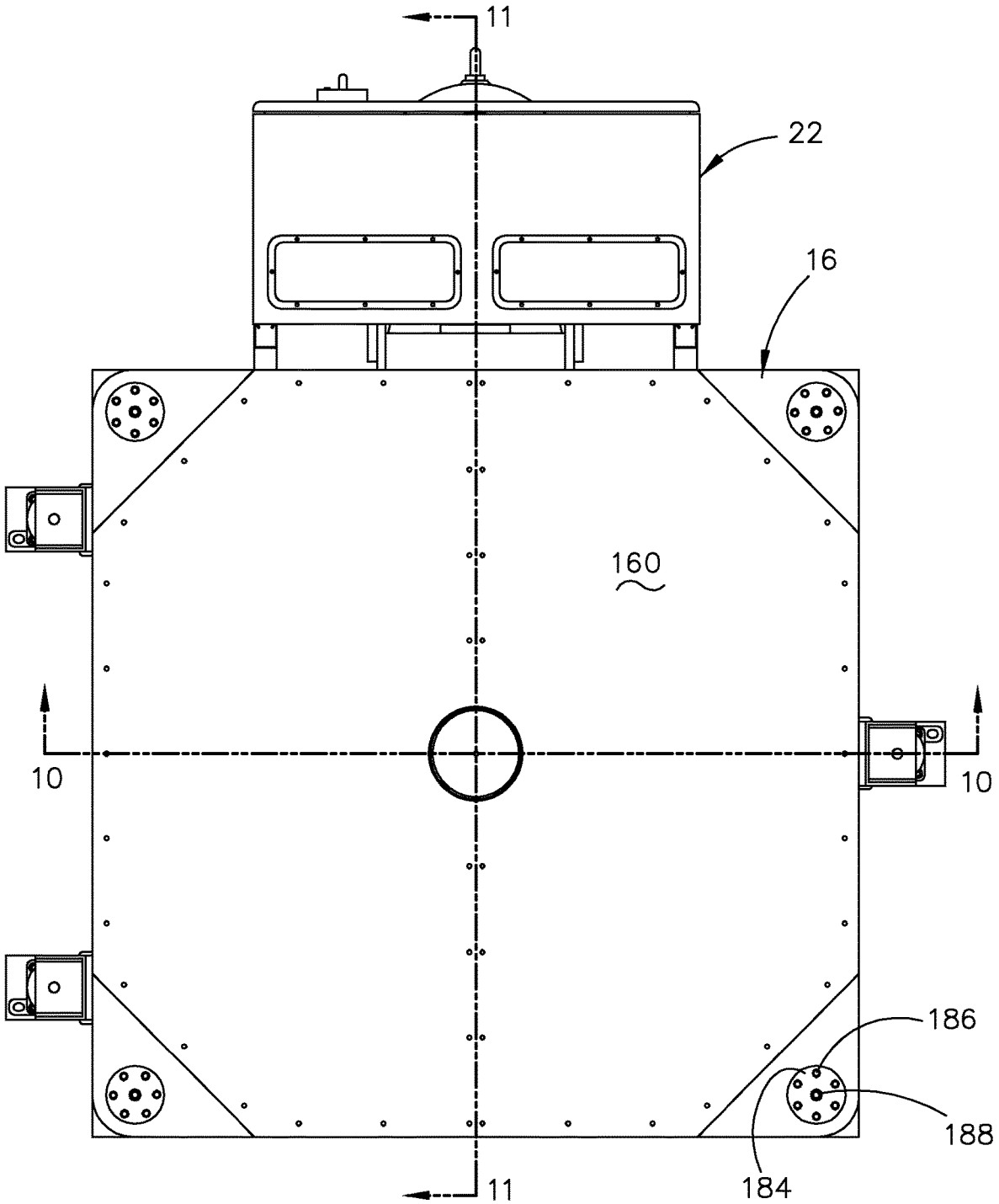
FIG. 6 is a top plan view of the degerminator of FIG. 1.
Figure 7:
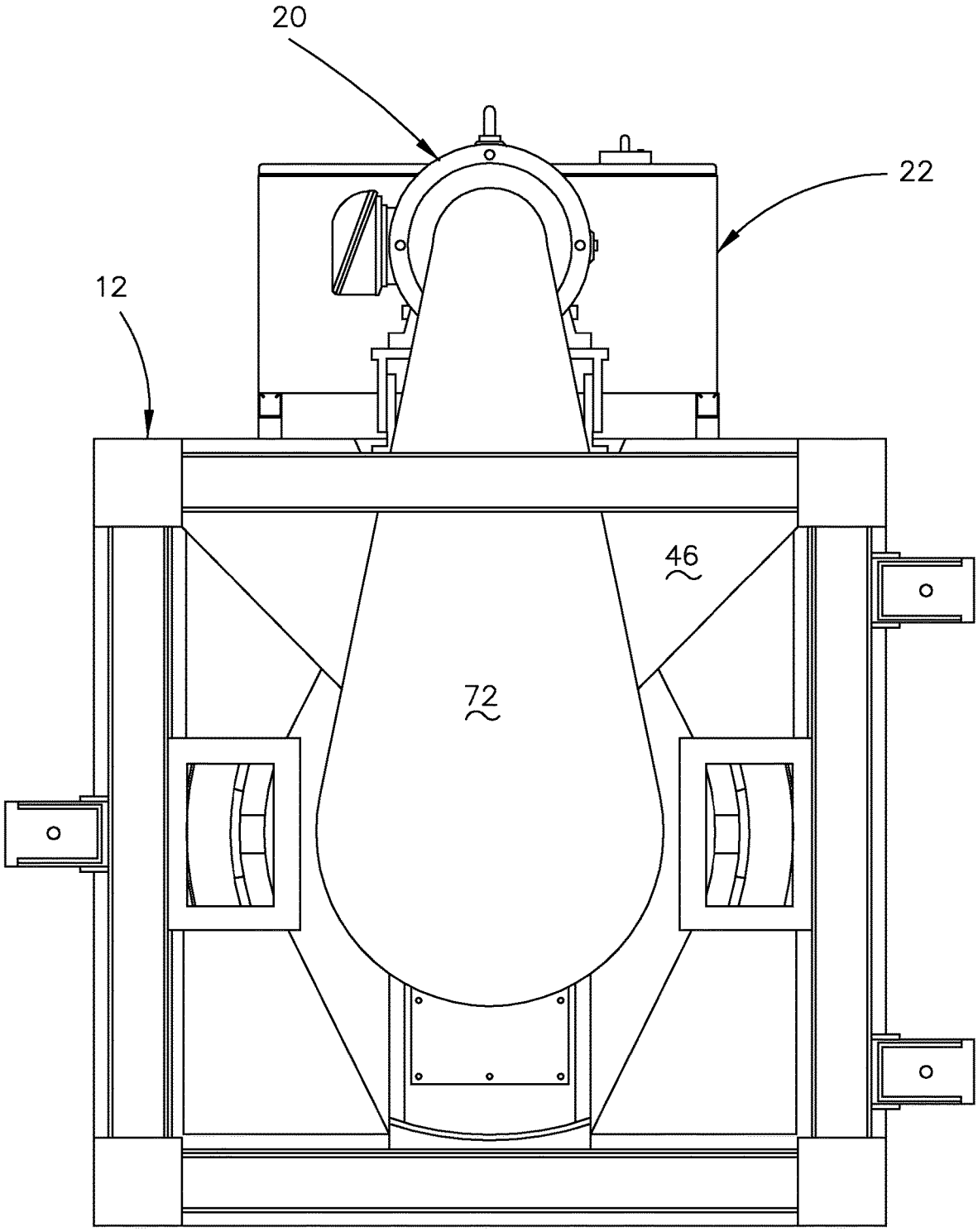
FIG. 7 is a bottom plan view of the degerminator of FIG. 1.

As shown in FIGS. 2 and 3, supports 182*a-d* are each mounted to one of the four corners of box frame 160. Support 182*a* is mounted to box frame 160 with a mounting plate 184 shown in FIG. 6. Mounting plate 184 is mounted to box frame 160 with a plurality of bolts, one of which is identified as 186, and mounting plate 184 is mounted to support 182*a* with a bolt 188 to rigidly mount support 182*a* to box frame 160. Supports 182*b-d* are mounted to box frame 160 in a substantially similar manner. Supports 182*a-d* are preferably rods as shown in the drawings, but the supports 182*a-d* may have any suitable shape.

Figure 18:
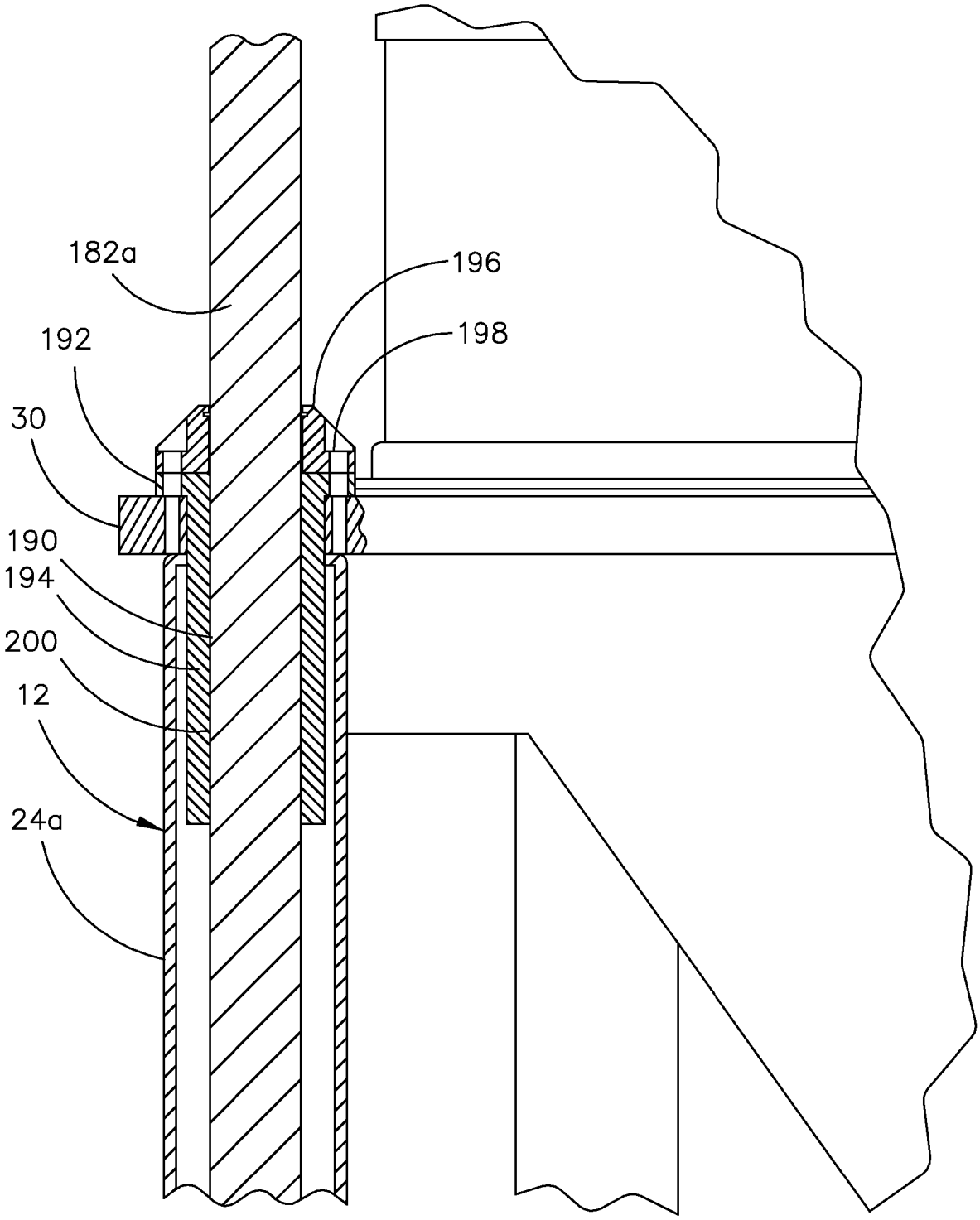
FIG. 18 is a cross-sectional view taken through the line 18-18 in FIG. 5.

Referring to FIG. 18, a guide 190 is mounted to the platform 30 of frame 12. Guide 190 includes a flange 192 that rests on an upper surface of platform 30 and a hollow cylinder 194 that is positioned within leg 24*a*. A guide mount 196 is positioned above guide 190 and receives a plurality of bolts, one of which is identified as 198, which pass through guide 190 and into platform 30. The guide 190 is preferably a bearing or bushing with an inner opening 200 that receives support 182*a* and has substantially the same inner diameter as the outer diameter of support 182*a*. Guide 190 permits support 182*a* to move vertically, but does not permit support 182*a* to move laterally in any substantial amount. Guides (not shown) similar to guide 190 are mounted to frame 12 to receive supports 182*b-d* in a similar manner as described above with respect to support 182*a*. All of supports 182*a-d* and guides 190 in combination allow upper plate assembly 16 to move vertically, but do not allow upper plate assembly 16 to rotate or move laterally in any substantial manner. Supports 182*a-d* and guides 190 ensure that upper plate assembly 16 remains in a desired horizontal orientation as it moves vertically and ensure that all portions of upper plate assembly 16 move an equal amount at the same time. Although supports 182*a-d* are preferably mounted to upper plate assembly 16 and guides 190 are preferably mounted to frame 12, it is within the scope of the invention to mount supports 182*a-d* to frame 12 and guides 190 to upper plate assembly 16. Degerminator 10 may include more or less than four supports 182*a-d* and four guides 190.

Box frame 160 includes three upper actuator mounts, one of which is identified as 202 in FIG. 1. Upper actuator mount 202 includes structure configured to mount an upper end of actuator 18*a* to upper plate assembly 16. Actuators 18*b* and 18*c* are mounted to upper plate assembly 16 in a similar manner. Actuators 18*a-c* are preferably linear actuators that are operable to vertically move upper plate assembly 16 in 0.001 inch increments. Degerminator 10 may include more or less than three actuators.

Referring to FIG. 12, upper base 162 includes a circular plate 204, an annular plate 206 mounted to circular plate 204 with a plurality of bolts, one of which is identified as 208 in FIG. 12, and a central diffuser 210 mounted to circular plate 204 with a plurality of bolts, one of which is identified as 212. Circular plate 204 includes a central opening 214 that receives inlet tube 168 (FIG. 10). Central diffuser 210 includes a central opening 216 that is aligned with central opening 214 and a conical shaped surface 218 that slopes downward and radially outward from central opening 216 to upper plate 166. Annular plate 206 surrounds a portion of central diffuser 210.

Figure 14:
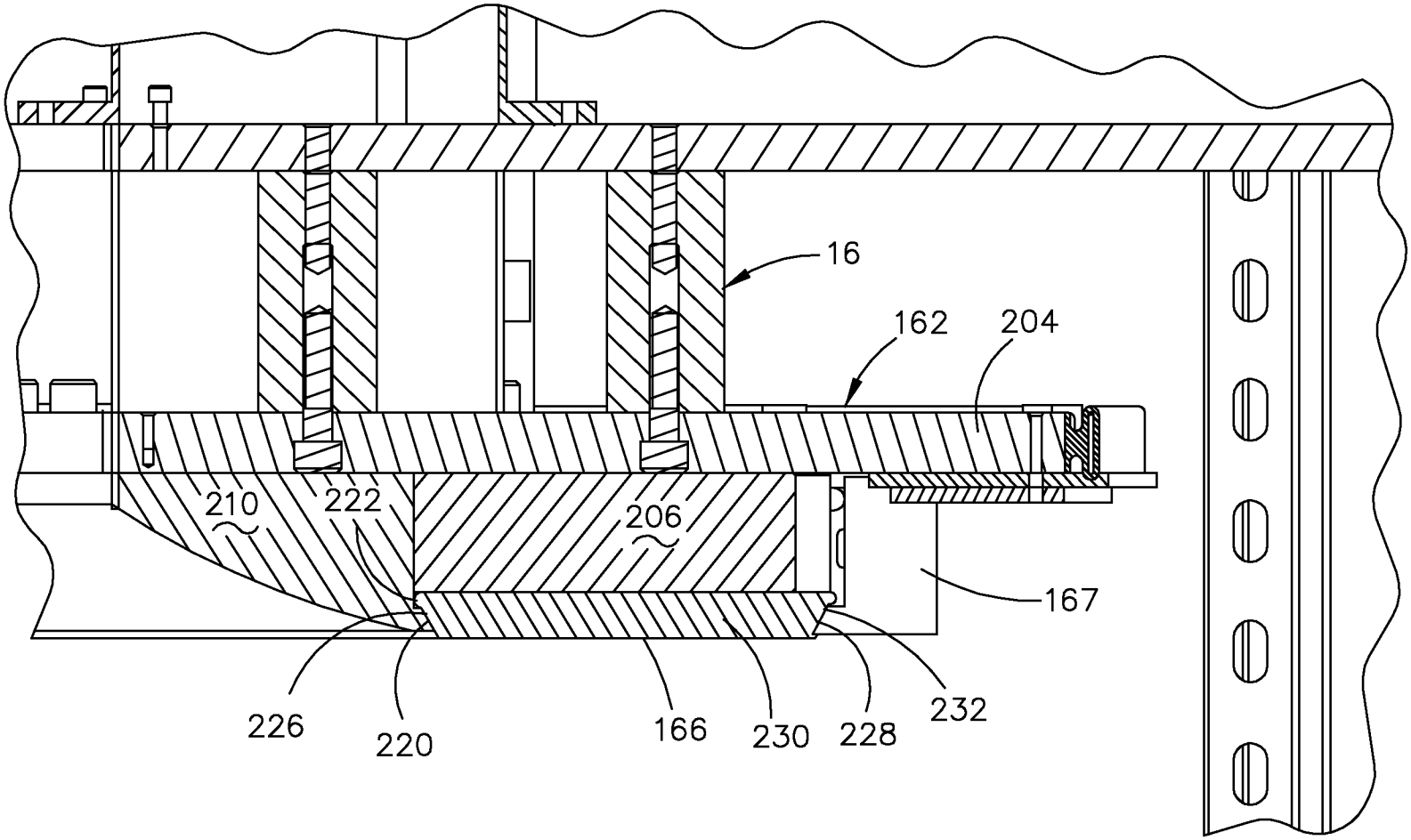
FIG. 14 is a cross-sectional view of a portion of the upper plate assembly in the raised position.

As shown in FIG. 14, central diffuser 210 has a lower edge surface 220 that extends beneath a portion of annular plate 206 to form an annular recess 222 positioned between central diffuser 210 and annular plate 206. Lower edge surface 220 is angled from vertical radially outward away from a center of upper plate assembly 16 as lower edge surface 220 moves downward away from recess 222, such that a lower portion of lower edge surface 220 extends radially outward farther than an upper portion of lower edge surface 220.

Figure 20:
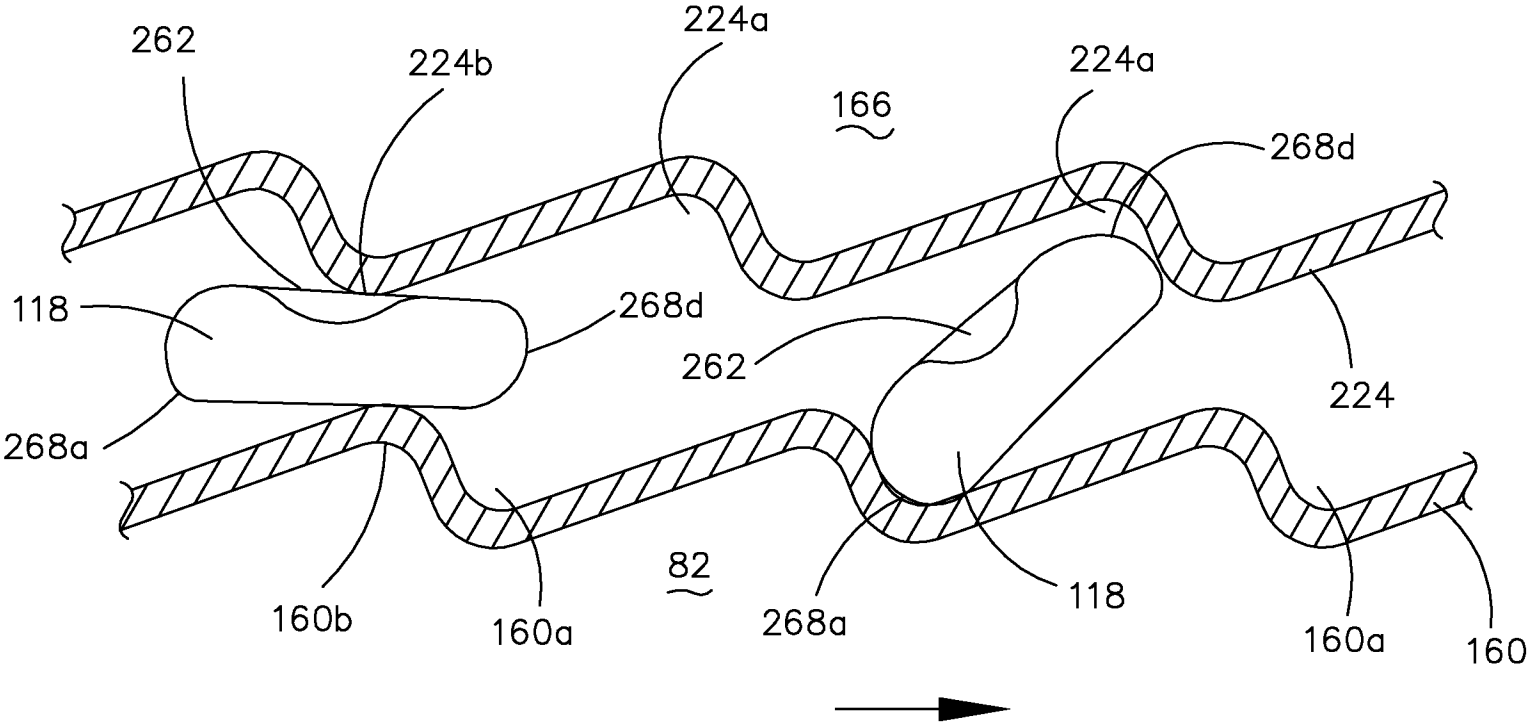
FIG. 20 is a cross-sectional view taken through the line 20-20 in FIG. 13.

Upper plate 166 is substantially similar to lower plate 82 and as such is only described herein to the extent necessary to describe how upper plate 166 is mounted to upper base 162. Upper plate 166 is formed from six sections, in a similar manner as lower plate 82, and upper plate 166 has corrugations 224 (FIG. 20) that are arranged in substantially the same manner as the corrugations 160 of lower plate 82. The corrugations 224 of upper plate 166 face the corrugations 160 of lower plate 82, as shown in FIG. 20.

Upper plate 166 is annular with an inner edge surface 226, an outer edge surface 228, and a working surface 230 extending between the inner edge surface 226 and the outer edge surface 228. A portion of the inner edge surface 226 is received within recess 222. Inner edge surface 226 mates with lower edge surface 220 of upper base 162 in a non-vertical plane. Inner edge surface 226 angles radially outward away from a center of upper plate assembly 16 as inner edge surface 226 moves downward away from recess 222, such that a lower portion of inner edge surface 226 is positioned radially outward farther than an upper portion of inner edge surface 226.

Outer edge surface 228 angles radially inward toward a center of upper plate assembly 16 as outer edge surface 228 moves downward away from upper base 162. An angled surface 232 of clamp 167 is configured to mate with outer edge surface 228 in a non-vertical plane. Angled surface 167 angles radially inward toward a center of upper plate assembly 16 as angled surface 167 moves downward away from upper base 162. Clamp 167 is substantially similar to clamp 84 shown in FIG. 16. Thus, clamp 167 has an opening (not shown) that receives a bolt (not shown), which threads into an opening (not shown) within upper base 162 to secure upper plate 166 to upper base 162. Clamp 167 engages upper plate 166 to secure upper plate 166 between the lower edge surface 220 of upper base 162 and the angled surface 232 of clamp 167. A portion of inner edge surface 226 is positioned within recess 222 to prevent upper plate 166 from lowering when clamped to upper base 162. Mating angled surfaces 220 and 226 and mating angled surfaces 228 and 232 also prevent upper plate 166 from lowering when clamped to upper base 162. A detent (not shown) threads into upper base 162 and protrudes outward from upper base 162 in a similar manner as described above with respect to lower base 80. The detent (not shown) is received within a depression (not shown) in clamp 167 for positioning clamp 167 as it is tightened to upper base 162.

In a similar manner as described above for lower plate 82, one of clamps 167 is positioned in the center of each of the sections of upper plate 166, and one of clamps 167 is positioned where adjacent sections of upper plate 166 meet. Each of clamps 167 that is positioned where adjacent sections of upper plate 166 meet engages both of the adjacent sections to clamp both of the adjacent sections to upper base 162. Clamping each of the sections of upper plate 166 to upper base 162 in three locations in the manner described herein ensures that the working surfaces 230 of the sections of upper plate 166 are aligned in the same plane with each other. Even if the working surfaces 230 of the sections of upper plate 166 are slightly warped or bowed due to manufacturing imperfection, clamps 167 secure the sections of upper plate 166 to upper base 162 in a manner that flexes the sections of upper plate 166 to ensure that the working surface 230 presented by all of the sections of upper plate 166 in combination is aligned and continuous. Thus, there are preferably no ridges in working surface 230 at the locations where the sections of upper plate 166 meet. Working surface 230 may be planar and horizontal or shaped as part of a conical surface that is angled upwardly or downwardly as it extends radially outward. Clamps 167 may be removed to replace the sections of upper plate 166 that are worn or to replace sections with sections having a larger or smaller diameter, as described in more detail below with respect to FIG. 19.

Clamps 167 are designed to secure upper plate 166 to upper base 162 such that there are no mounting holes in upper plate 166 that extend through the working surface 230 of upper plate 166. Therefore, the entire working surface 230 is available for configuration to engage and fracture corn kernels 118, and there are no unwanted holes or depressions in the working surface 230 to trap corn particles or disrupt the fracturing process. Preferably, and as shown in the drawings, there are no mounting holes formed in any surface of upper plate 166.

Figure 15:
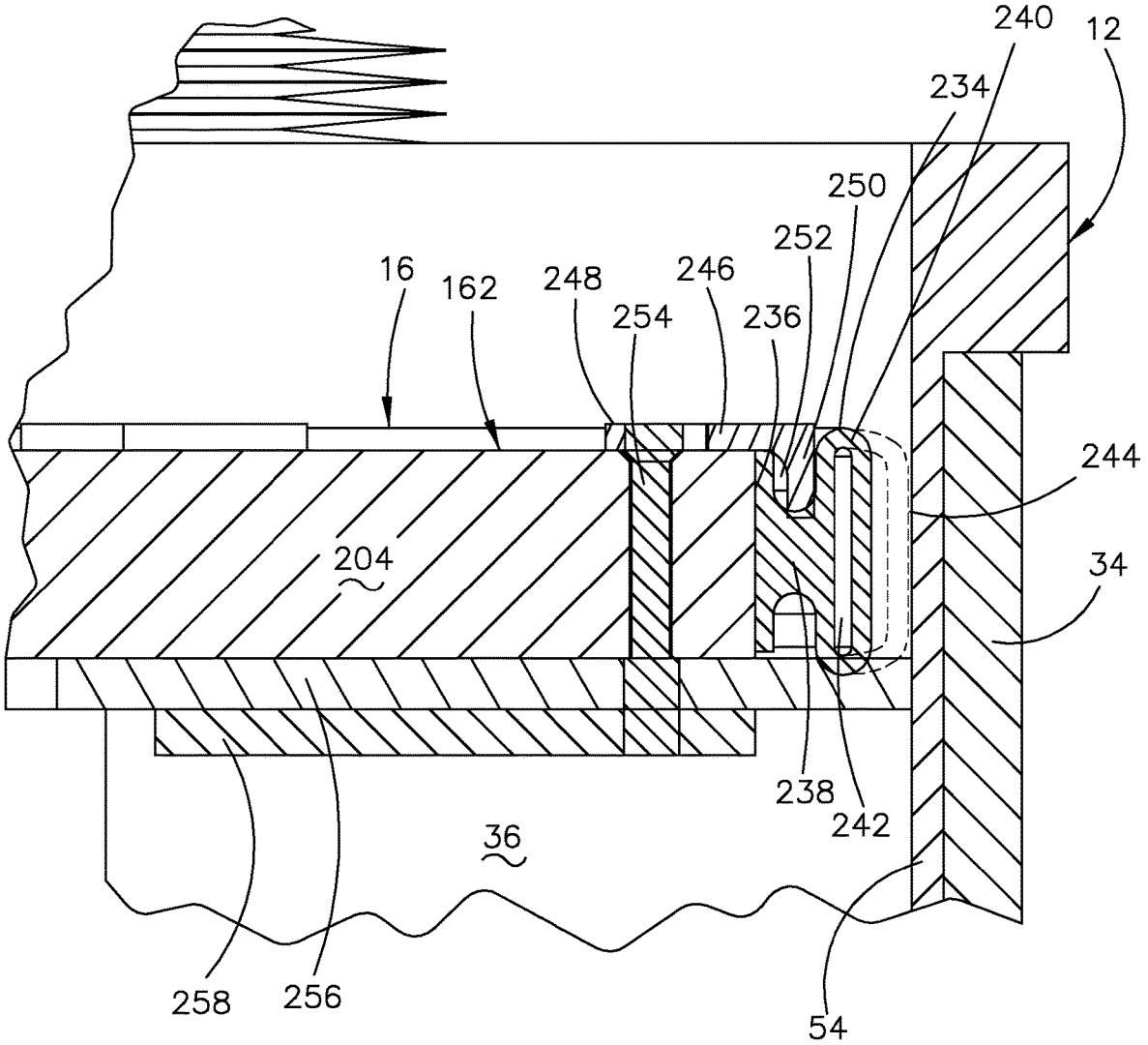
FIG. 15 is a cross-sectional view showing a seal of the upper plate assembly.

As shown in FIGS. 12 and 15, a seal 234 is mounted to a peripheral edge of circular plate 204. Referring to FIG. 15, seal 234 has a generally vertical surface 236 that engages circular plate 204, a horizontal section 238 extending radially outward from vertical surface 236, and a torus-shaped section 240 extending radially outward from horizontal section 238. Torus-shaped section 240 encloses a channel 242 that is in fluid communication with an air compressor (not shown), which provides compressed air to channel 242 for moving the seal 234 between a deflated position, shown in FIG. 15 in solid lines, and an inflated position, shown in FIG. 15 in dashed lines. When seal 234 is in the inflated position and upper plate assembly 16 is in a lowered position in which it is received within side wall 34 of frame 12, an outer surface 244 of seal 234 engages wear ring 54 to form a seal between seal 234 and wear ring 54 that prevents contaminants from entering chamber 36 and corn particles from exiting chamber 36. Torus-shaped section 240 of seal 234 expands radially outward from upper base 162 as the seal 234 moves from the deflated position to the inflated position.

When seal 234 is inflated and it engages wear ring 54, upper plate assembly 16 may be moved vertically approximately 0.25 inches in either direction to adjust the gap 120 (FIG. 13) between lower plate 82 and upper plate 166 without damaging seal 234 or breaking the seal between seal 234 and wear ring 54. Thus, vertical adjustments may be made to upper plate assembly 16 during operation of degerminator 10 without breaking the seal between seal 234 and wear ring 54. Allowing seal 234 to remain in place as vertical adjustments are made prevents contaminants from entering chamber 36 and corn particles from exiting chamber 36 during operation. Seal 234 only needs to be deflated before upper plate assembly 16 is moved vertically a relatively large amount, such as when upper plate assembly 16 is raised to an upper position, as shown in FIG. 1, in which seal 234 is not positioned within side wall 34.

Seal 234 is mounted to circular plate 204 with a plurality of seal clamps, one of which is identified as 246. Seal clamp 246 is generally L-shaped with a horizontal section 248 that abuts an upper surface of circular plate 204 and a vertical section 250 that is positioned within a groove 252 formed between vertical surface 236 and torus-shaped section 240 of seal 234. Horizontal section 248 has an opening that is aligned with an opening in circular plate 204; the aligned openings receive a bolt 254.

A wiper seal 256 is mounted to circular plate 204 beneath seal 234. Wiper seal 256 is generally annular and extends around the entire diameter of circular plate 204. Wiper seal 256 may be formed in a plurality of sections that are each joined to circular plate 204. Wiper seal 256 includes an opening that is aligned with the openings in seal clamp 246 and circular plate 204. Bolt 254 threads into the opening in wiper seal 256. Wiper seal 256 extends radially outward beyond the peripheral edge of circular plate 204 beneath seal 234 to protect seal 234. Wiper seal 256 has an outer diameter that is substantially equal to the inner diameter of wear ring 54 such that wiper seal 256 engages wear ring 54. As wiper seal 256 is lowered into wear ring 54, wiper seal 256 scrapes corn particles and contaminants from wear ring 54 to protect seal 234 from damage. Wiper seal 256 is preferably formed from a rigid material such as ultra high molecular weight polyethylene.

A seal protector 258 is mounted to circular plate 204 beneath wiper seal 256. Seal protector 258 is generally annular and extends around the entire diameter of circular plate 204. Seal protector 258 may be formed in a plurality of sections that are each joined to circular plate 204. Seal protector 258 includes an opening that is aligned with the openings in seal clamp 246, wiper seal 256, and circular plate 204. Bolt 254 threads into the opening in seal protector 258. Seal protector 258 is preferably formed from metal.

Figure 25:
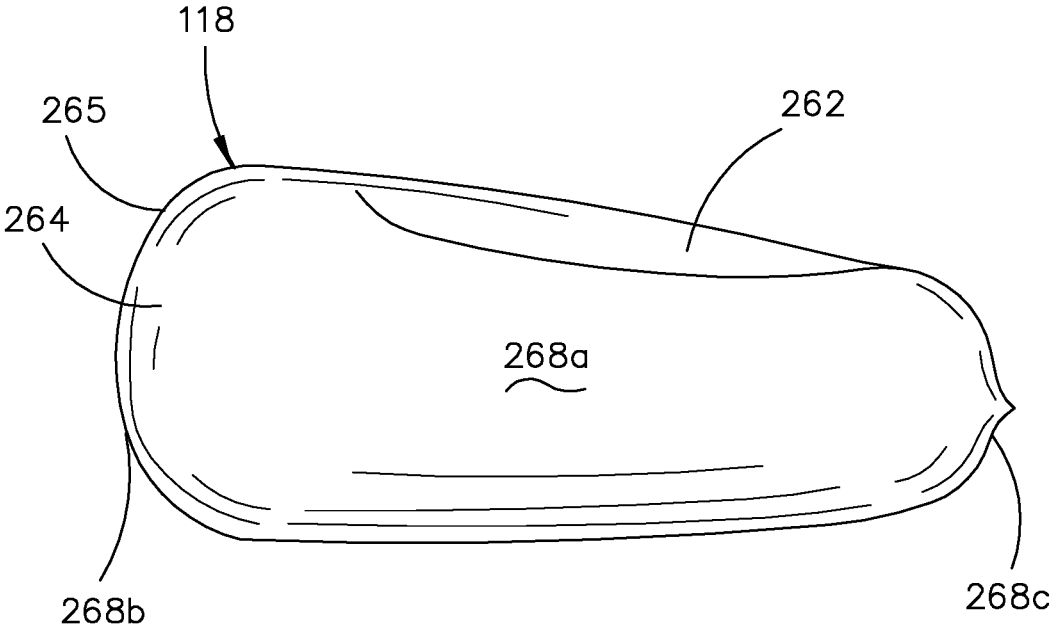
FIG. 25 is a side elevational view of a corn kernel.

With reference to FIGS. 25 and 26, a corn kernel is designated by the numeral 118 and has a germ portion 262, an endosperm portion 264, and a pericarp or bran portion 265 that surrounds the germ portion 262 and endosperm portion 264. FIG. 26 shows one of the relatively large flat side surfaces of the kernel which has been designated by the numeral 266. A second large flat side surface (not shown) is opposite and parallel surface 266. The two side surfaces 266 are separated by relatively thin side edges 268*a-d*. The top side edge is designated 268*b* and the bottom side edge or tip is designated 268*c*. The width of the side edges is equal to the thickness of the corn kernel.

Referring to FIG. 20, corrugations 160 and 224 are inclined and are sized so that a corn kernel 118 in an inclined orientation can fit with one of its thin side edges 268*d* in the groove 224*a* of an upper corrugation 224 and with the opposite side edge 268*a* of the kernel located in the groove 160*a* of a lower corrugation 160 (see the kernel in the right portion of FIG. 20). However, when the grooves 160*a* and 224*a* of the corrugations 160 and 224 are located directly above one another, the grooves 160*a* and 224*a* are spaced apart a distance less than the width of kernel 118 between its opposite side edges 268*a* and 268*d*. Ridges 160*b* and 224*b* of corrugations 160 and 224 are vertically spaced apart a distance at least as great as the thickness of kernel 118 between its relatively large opposite side surfaces 266. The corrugations are smoothly rounded on their ridges 160*b* and 224*b* and grooves 160*a* and 224*a* to avoid presenting sharp edges or corners that might cut the grain. Corrugations 160 and 224 may have other configurations other than as described herein that are suitable for fracturing corn kernels 118 or other types of grain.

Control system 22 (FIG. 1) preferably includes at least one user input device (not shown) that is operable to turn on motor 60 for rotation of lower plate assembly 14, to turn on actuators 18*a-c* for moving upper plate assembly 16, to turn on an air compressor (not shown) for pressurizing seal 234 and spindle housing 74, and to control a gate or door (not shown) that allows corn kernels to enter inlet tube 168. Control system 22 is electrically coupled with motor 60, actuators 18*a-c* and the air compressor (not shown) to carry out these functions on demand. Control system 22 also preferably includes a display (not shown) so that a user can view the status of the motor 60, the position of upper plate assembly 16, and the status of seal 234. Control system 22 may also include a memory (not shown) that is configured to record the vertical position of upper plate assembly 16, and a processor (not shown) that is configured to upon demand retrieve the stored vertical position of upper plate assembly 16 from the memory and turn on the actuators 18*a-c* until the upper plate assembly 16 is moved to the stored vertical position.

Figure 19:
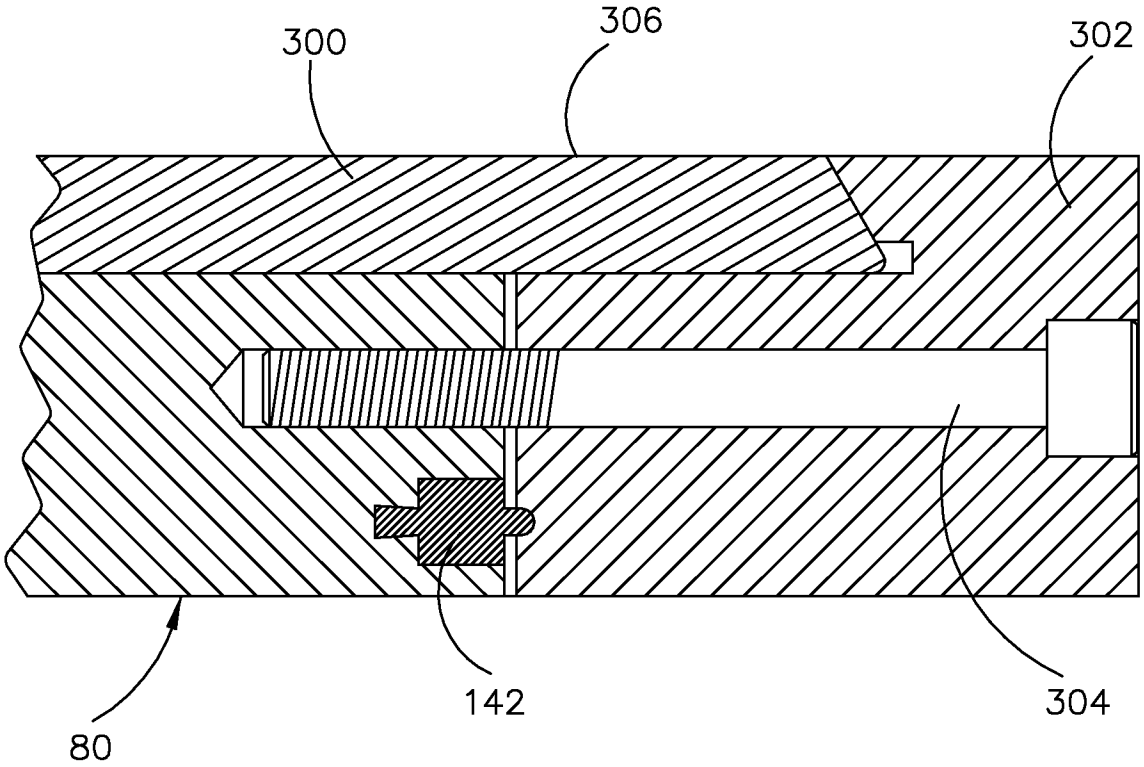
FIG. 19 is a cross-sectional view of a portion of the lower plate assembly showing an alternative embodiment of a lower plate and a clamp.

FIG. 19 shows an alternative embodiment of lower plate 300 and clamp 302. Lower plate 300 is substantially similar to lower plate 82 described above except that lower plate 300 has an outer diameter that is larger than the outer diameter of lower plate 82 to the extent that lower plate 300 extends radially outward beyond the outer peripheral edge of lower base 80. Lower plate 300 clamps to base 80 in a similar manner as lower plate 82 described above except that an alternative clamp 302 is used in order to fill the space below lower plate 300 where it extends radially outward beyond base 80. A longer bolt 304 must also be used to mount clamp 302 to base 80. If lower plate 300 is used in place of lower plate 82, preferably upper plate 166 is also substituted for an upper plate (not shown) having an outer diameter that is substantially the same as lower plate 300. Lower plate 300 preferably includes more rows of corrugations than are present in lower plate 82, as shown in FIG. 12A, and has a working surface 306 with a substantially greater area than the working surface 130 of lower plate 82. The increased area of working surface 306 allows lower plate 300, along with a substantially equally sized upper plate (not shown), to process a greater weight of corn kernels or other grains in a given time than is the case with lower plate 82 and upper plate 166. A motor 60 with a larger power output is preferably used along with lower plate 300.

Side wall 34 (FIG. 13) of frame 12 is sized so that lower plate 300 and clamp 302 fit within the side wall 34. Thus, to replace lower plate 82 with lower plate 300, the only components that need to be removed are lower plate 82, clamps 84, and spacers 86. Lower plate 300 is then placed on base 80 and secured to base 80 with a plurality of clamps 302. Alternative spacers (not shown) having a configuration substantially similar to clamp 302 may also be used with lower plate 300 in place of spacers 86.

In operation, an operator accesses control system 22 and instructs the control system 22 to turn on actuators 18*a-c* to move upper plate assembly 16 into a position in which the gap 120 (FIG. 13) between lower plate 82 and upper plate 166 is at a desired distance. The seal 234 is then pressurized so that the seal 234 expands to engage the wear ring 54. Motor 60 is then powered on to rotate lower plate assembly 14, and corn kernels 118 are allowed to enter the inlet tube 168. As shown in FIG. 13, the corn kernels 118 slide down conical outer surface 114 into the gap 120 between lower plate 82 and upper plate 166 such that the kernels 118 are positioned with side surface 266 facing up or down.

The conical outer surface 114 and conical shaped surface 218 are preferably configured and spaced apart from each other during operation to guide corn kernels 118 into the gap 120 in a single, horizontal plane. In other words, when corn kernels 118 enter gap 120, side surface 266 is horizontal and corn kernels 118 are not stacked on top of each other. Concave, conical outer surface 114 and convex, conical shaped surface 218 oppose each other and are spaced apart a distance to facilitate the corn kernels 118 entering the gap 120 in a single, horizontal plane. Because the corn kernels 118 enter the gap 120 in a single, horizontal plane, the corn kernels 118 do not grind against themselves, i.e., individual corn kernels 118 do not grind against other individual corn kernels 118. By substantially preventing the corn kernels 118 from grinding against each other, the degerminator 10 releases each of the germs of the corn kernels 118 in a substantially whole, undamaged condition.

As lower plate assembly 14 rotates, corrugations 160 move in the direction indicated by the directional arrow in FIG. 20. When a corn kernel 118 positioned between the lower plate 82 and upper plate 166 is oriented with its large flat sides 266 facing up and down (as shown for the kernel 118 in the left hand portion of FIG. 20, the kernel 118 passes freely between the ridges 160*b* and 224*b* of corrugations 160 and 224 so that no crushing occurs. However, when the kernel 118 is displaced in any fashion from this orientation, opposed side edges 268*a* and 268*d* or 268*a* and 268*c* of the kernel 118 catch in the grooves 160*a* and 224*a* of opposed corrugations 160 and 224. This is the position of the kernel 118 shown in the right hand portion of FIG. 20.

Continued motion of lower plate 82 relative to upper plate 166 subjects the kernel 118 caught between the corrugations 160 and 224 to a compressive crushing force that is applied from opposed side edges 268*a* and 268*d* or 268*a* and 268*c* of the kernel 118 toward the center. The magnitude of this crushing force is sufficient to fracture the endosperm under and around the germ 262 to thereby squeeze or pop the germ 262 out of the side 266 of the kernel 118 in a substantially whole, undamaged condition. The crushing action terminates when the corrugations 160 and 224 move past one another. Since the released germ 262 is small enough to pass freely between the ridges 160*b* and 224*b* of the corrugations 160 and 224, the germ 262 is not crushed and is carried outwardly by centrifugal force along with the fragments of the endosperm 264 resulting from the crushing action toward side wall 34. The fractured corn particles exit the gap 120 between lower plate 82 and upper plate 166 adjacent side wall 34 and move downwardly through one of exit chutes 38 and 40 for further processing as described below in connection with FIGS. 21-24. The fines resulting from the degermination contain very little germ 262 since the germ 262 is maintained whole. The corrugations 160 and 224 also preferably separate the pericarp or bran 265 from the endosperm 264.

The corn kernel 118 may be tempered prior to the degermination, although tempering is not essential. The amount of whole and relatively undamaged germ 262 that is released and the extent to which the germ 262 and endosperm 264 are separated is a function of a number of factors, including the moisture content of the germ 262, the type and condition of the corn kernel 118, the configuration of the corrugations 160 and 224, the distance between corrugations 160 and 224, or combinations of these and other factors.

Exemplifying the improved results obtained by the degerminating method of this disclosure, it has been found that midwestern hybrid corn of about 12% moisture and average condition and age yields approximately 85% whole germ 262 and slightly more than 95% separation of germ and endosperm. Tempering the same type of corn to about 17% moisture content for about 3 hours increases the yield to about 95% whole germ and about 97% complete separation of germ and endosperm. The degerminator fines that will pass through a 16 mesh screen vary in quantity from a high of about 20% of the corn degerminated to a low of about 10%, and from a fat content of about 1% to about 5%, depending on the tempering process, the moisture content of the germ and endosperm, the kind of corn, the condition and age of the corn, the relative speed of rotation of lower plate 82 and upper plate 166, the spacing between the lower plate 82 and upper plate 166, the configuration and arrangement of the corrugations 160 and 224, and the condition of the working surfaces 130 and 230.

Although the degerminator 10 is similar in construction to a conventional attrition mill, the operational characteristics differ considerably. The main difference is that the lower plate 82 and upper plate 166 are carefully spaced and the corrugations 160 and 224 are arranged to achieve only a crushing effect on the kernel 118 which is applied only from the opposite thin edges 268*a-d* inwardly toward the center, in contrast to the grinding and cutting action of an attrition mill. Since lower plate 82 and upper plate 166 are spaced apart such that a corn kernel 118 oriented with its flat sides 266 parallel to the planes of the plates 82 and 166 passes freely between the ridges 160*b* and 224*b* of the corrugations 160 and 224, the degerminator 10 avoids crushing the corn kernels 118 from the relatively large flat sides 266 thereof, thus assuring that the crushing occurs only at the thin edges 268*a-d* in a manner to squeeze the germ 262 free of the endosperm 264.

In addition to the effectiveness of the germ separation, the process of the present disclosure separates the bran 265 from the endosperm 264 with excellent results. As the moisture content of the bran 265 increases, its separation becomes more complete. It has been found that if dry corn of about 14% moisture is tempered for 4 to 8 minutes with addition of water of about 2% to 8% by weight of the corn kernels 118, 90% to 98% of the bran 265 is removed by the degerminating process as a result of the crushing forces applied to the corn kernels 118. The degree of debranning is affected by the kind and condition of the corn kernels 118, the amount of water and heat added and the length of time held, the speed of the lower plate 82, and the configuration of corrugations 160 and 224. Since on a practical level only the bran 265 is tempered and not the remainder of the corn kernels 118, drying is simplified because only the bran 265 needs to be sorted out by screens and/or aspiration and sent to dryers. Conventional methods of debranning require tempering of the germ 262 also and/or separate equipment to perform this function. In carrying out the method of the present disclosure, the power requirements are about 2.5 HP per hour per ton of corn, as compared with requirements of conventional processes of from 15 to 25 HP per hour per ton of corn for degerming and debranning.

Another important result obtained by the degerminating process of this disclosure is the relatively high quality of the degerminator fines which, as previously indicated, have a fat content of about 1% to 5%. In comparison, the fines generated in conventional degerminating processes are so high in fat that they are either sold as a low value byproduct animal feed or are reprocessed to upgrade their quality. Such reprocessing involves the use of sifter, aspirators, gravity tables, purifiers or various combinations of these and other costly devices. Upgrading the quality of the fines with such devices allows the fines to move into industrial uses or other markets where they yield a higher price than animal feed but a lower price than prime products from the mill. In addition, separation of the fines from the prime product is costly and time consuming.

The present disclosure also provides improved grain milling processes which are illustrated in flow sheet form in FIGS. 21-24. The whole grain or corn kernel 118 or a major part of it may be tempered in some of the processes, although tempering is not always required if the preferred degerminating process described above is used, due to the high degree of degermination and the high quality of the fines. The particular process that may be employed to the best advantage in each set of circumstances depends upon a variety of factors, including the end products desired, the type and condition of the grain, and economic considerations such as operating costs and marketing objectives.

Figure 21:
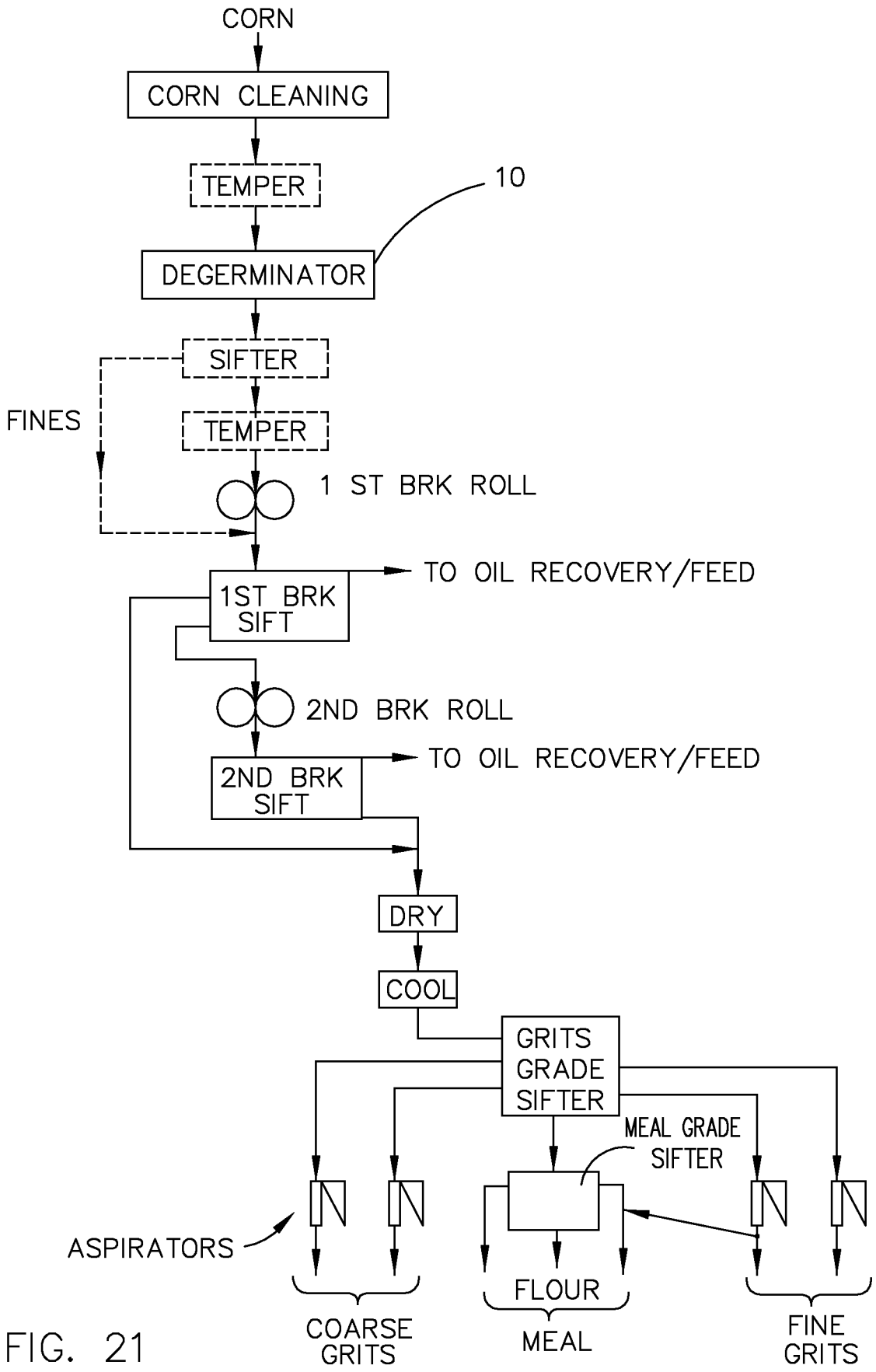
FIG. 21 is a flow diagram of a milling process in accordance with one embodiment of the present disclosure.

Referring first to FIG. 21, the process shown therein involves cleaning of the corn followed by prebreaking in degerminator 10. The degerminator 10 breaks the grain by subjecting it to a crushing action that breaks the endosperm 264 while preferably although not necessarily maintaining a substantial amount of the germ 262 in a whole condition. The grain should be broken along the germ 262 so the germ 262 is exposed. The crushing action should fracture the grain into at least four and preferably six or more major pieces. The germ 262 should be separated from the endosperm 264 to as great an extent as possible because the fat content of the finished products is reduced as the degree of separation increases. The actual degree of separation of the germ 262 and the extent to which the germ 262 remains whole depend upon the particular prebreaking process utilized and the end product desired.

Tempering of the grain may be carried out in advance of the prebreak or after the prebreak, or both. Tempering before the prebreak better controls the germ separation. For example, corn having a moisture content of 15% to 20% by weight will, when broken, provide better release of the germ with a corresponding reduction in fines and fat content than corn having a moisture content below about 15%. The tempering can be carried out using known techniques.

Tempering after prebreaking may be carried out if the moisture content of the germ and bran was not adjusted by a tempering step prior to prebreak, or if additional moisture adjustment is necessary or desired after prebreak. The moisture content of the germ and bran prior to passage of the stock to the first roller mill should be about 15% to 35% by weight. Tempering after prebreak results in an appreciable shortening of the tempering time because the prebreaking exposes the germ and bran. Tempering can be as short as 2 minutes if heat is used and in no case will it exceed about 30 minutes when performed subsequent to prebreak.

Although a main advantage of the process of this disclosure is that it avoids the need to remove fines prior to milling, it may be desirable in some instances to remove the fines after prebreak and before milling in order to reduce the water requirements for the tempering step. This can be done in a sifter which sifts the stock after prebreak and before tempering if tempering occurs only after prebreak. The fines are then separated and returned to the stock after it has been tempered and passed through the first set of break rolls if this is desirable to simplify the flow.

The present disclosure departs from the technique of the conventional grain milling process which, as previously indicated, attempts to match particle size with individual roller mill characteristics. In the conventional gradual reduction process, the particles are first passed through roller mills having relatively large corrugations and then to successive additional roller mills having increasingly finer corrugations. It has heretofore been thought that any attempt to utilize rollers having fine corrugations at the front end of the mill would result in smashing of the grain kernels which would make ultimate separation of germ, bran and endosperm exceedingly difficult.

Instead of passing the grain through a long succession of rollers as is done in the conventional process, grinding is accomplished in the present disclosure by passing the broken grain directly to fine rollers of the type that normally characterize only the end of a differential milling process.

In accordance with the disclosure, the prebreaking and tempering steps are effected, and the grain is then passed through a first set of break rolls which may be of the modified Dawson type having 16 to 20 corrugations per inch and a spiral of about ½ inch per linear foot. The rollers are arranged dull to dull and have a differential roll speed of between approximately 1.1-1.4:1, more preferably between approximately 1.2-1.35:1, and most preferably the ratio is approximately 1.3:1. The first break roller mill is adjusted so that at least approximately 50% of the product through is small enough to pass through a U.S. #12 sieve. The spacing between the rollers is sufficient to substantially prevent appreciable penetration of the roller corrugations into the germ, thereby avoiding size reduction of the germ in contrast to the conventional practice of placing fine rollers closer together in accordance with the fine particles being processed. Each particle from the prebreak mill is large enough that it is subjected to grinding action when passed between the rollers of the first break mill and those of the second break mill. The first set of break rolls may have a structure and operate in the same manner as described in U.S. Pat. No. 8,113,447, the disclosure of which is hereby incorporated by reference herein.

Due to the fineness of the roller corrugations and their spacing, the endosperm is severely and abruptly ground up and thereby separated from the germ and bran without resulting in the germ being fractured excessively. The product from the first break rolls, together with the fines if they have been removed prior to temper, is sifted through a U.S. #8 sieve and a U.S. #12 sieve. The relatively large size particles over the #8 sieve are primarily germ and bran and may be directed to feed or oil recovery or to further processing as described below. The portion passing through the #12 screen is less than 1% in fat content, and it is therefore passed to finish product. Particles through the #8 screen but over the #12 screen are principally endosperm, although there is enough germ present that this portion is not marketable as a prime product. This portion is passed to a second set of break rolls which effect further size reduction of the endosperm and which further separate the endosperm from the germ and bran components.

The rollers of the second break mill have corrugations of the same size as the first set or slightly smaller, and the spacing between the rolls is again sufficient to avoid excessive penetration of the germ. Preferably, there are between approximately 20 to 30 corrugations per inch on each roller in the second break mill. The differential speed of the rollers in the second break mill is between approximately 1.1-1.4:1, more preferably between approximately 1.2-1.35:1, and most preferably the ratio is approximately 1.3:1. The second set of break rolls may have a structure and operate in the same manner as described in U.S. Pat. No. 8,113,447. After passing through the second set of break rolls, the product is sifted through a #14 wire. The particles over the wire are rich in germ and bran and go to animal feed or oil recovery. The stock passing through the wire is rich in endosperm and goes to finished product along with the endosperm rich stock from the first break mill. The endosperm rich stream is dried and cooled if necessary and is finally passed to a grading station where grits and meal are graded according to a size and any remaining bran is removed by aspiration.

The free germ may be removed prior to the first break rolls by utilizing gravity tables. This optional step lowers the fat content of the throughs from the sifter wires, and it aids in making the milling process superior to conventional processes both in quality and product yield.

Although the specific operating parameters for the process depend upon the age of the grain, its moisture content and grade, and the end product desired, it has been found, by way of example, that U.S. grade #2 corn having a moisture content of 13% yields approximately 62% brewer's grits on a U.S. #30 sieve at 1% maximum oil, 8% meal through a U.S. #30 sieve at less than 1.5% oil, 3% flour through a U.S. #80 sieve at about 2% maximum oil, and a brewer's extract on the grits of 80.5% as is basic and prescribed by the American Association of Brewing Chemist Methods. The total prime product yield is 73%. In comparison, a typical yield of equal quality products from a conventional process is 47% brewer's grits, 9% meal and 5% flour. The total prime product yield is 63% in the conventional process. In addition to providing a higher yield in the more valuable brewer's grits, the process of this disclosure yields a cereal grit and flour product of higher quality because of a reduction in "black specks." This is attributable to the reduced grinding which leaves most of the germ tip (black speck) attached to the bran or germ, although the extent to which this occurs decreases with a diminishing of the tempering.

Figure 22:
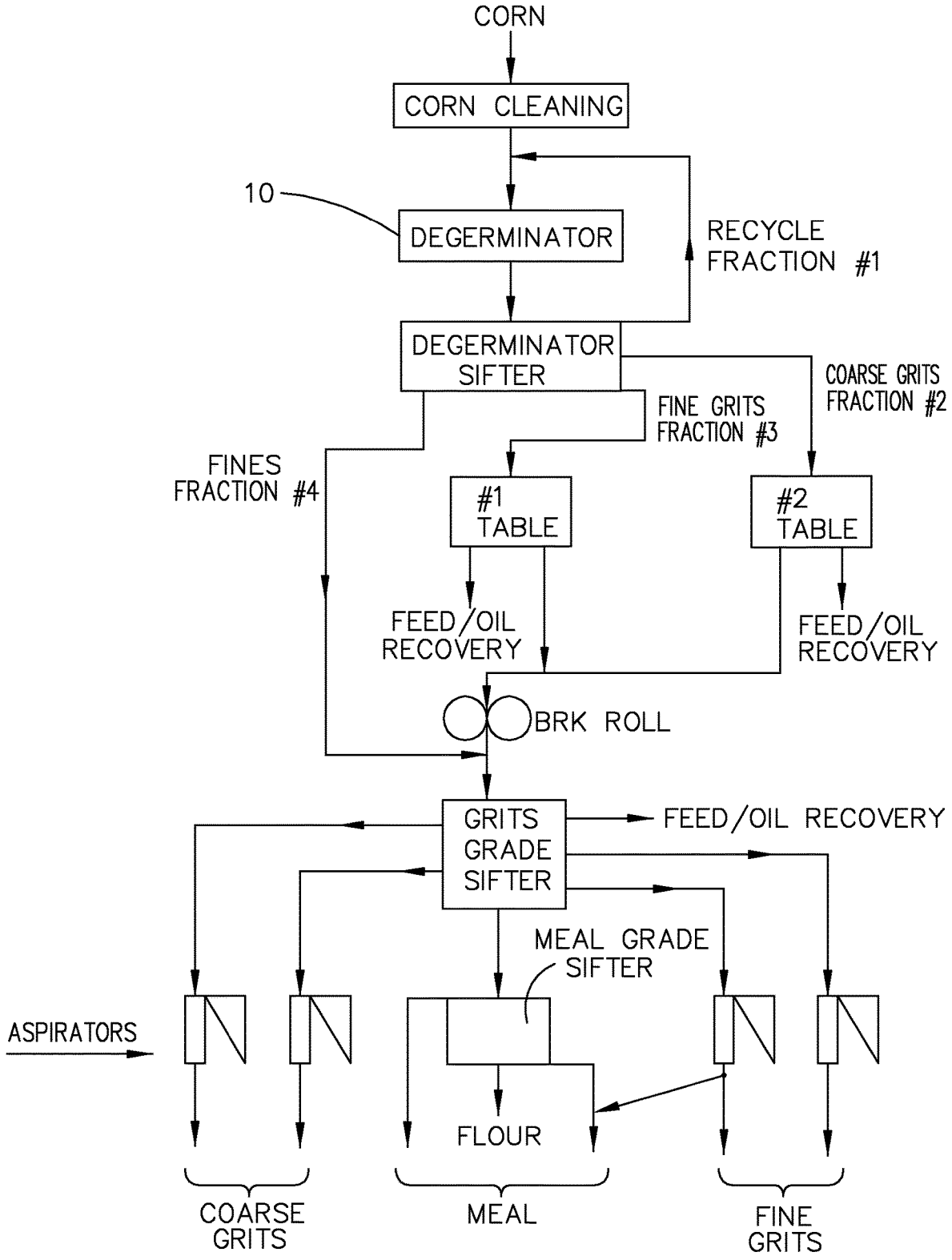
FIG. 22 is a flow diagram of another milling process in accordance with the present disclosure.

FIG. 22 illustrates a modified grain milling process which involves no tempering and has the objective of producing a maximum amount of brewer's grits. After the corn is cleaned, it is degerminated with degerminator 10. The grain is thereby crushed from its thin edges toward the center to achieve a high degree of separation of the germ from the endosperm while maintaining the germ in a substantially whole condition.

The degerminator stock is passed to a degerminator sifter which grades it into four streams containing particles of different size. A first stream consists of relatively large particles of whole corn or incompletely degerminated pieces of corn. It may not be necessary to separate out this first stream or fraction, depending on the scalp sieve size, the degerminator setting, the condition of the corn, and/or the object of the milling operation. The first stream is recycled or passed again through the degerminator.

The bulk of the degerminator stock is the second coarsest fraction which contains bran, the whole germ and the larger broken germ particles, as well as the pieces of broken endosperm passing over the second sieve. Depending upon a variety of factors, the second sieve can be from 5 to 9 mesh. The second fraction is passed to gravity table #1 where the germ and bran are sorted from the endosperm and directed to feed or oil recovery. If large quantities of corn are being processed so that sheer volume requires the use of a number of gravity tables, more efficient gravity table operation can be obtained by closer sizing of stream #2 into several streams and/or employing aspiration prior to passing the streams to the gravity tables. This will upgrade the finished product in both quality and quantity.

The third fraction includes broken germ, endosperm and bran normally making up between 5% and 25% of the total weight of the corn. This stream goes to gravity table #2 which sorts the germ and bran from the endosperm and directs them to animal feed or an oil recovery system. The endosperm is combined with the endosperm rich stream from gravity table #1 and passed to break rolls having fine corrugations that may be identical with those of the first break roll mill described in connection with the process of FIG. 21. The stock from the break rolls is combined with the fourth and finest fraction from the degerminator sifter.

In a grits grade sifter, most of the germ and bran still remaining in the stock are scalped off and directed to feed or oil recovery. The scalp sieve is about 10 to 16 mesh, depending upon the mesh of the sieve for the fourth fraction from the degerminator sifter. The grits grade sifter size classifies the remainder of the roller mill stock which is aspirated conventionally.

It has been found that with U.S. Grade #2 corn having a moisture content of 13%, the process of FIG. 22 yields about 57% brewer's grits over a U.S. #30 sieve with a fat content of 1% or less, about 9% meal through a U.S. #30 sieve and over a U.S. #80 sieve with 1.5% fat or less, and about 5% flour through a #80 sieve at 2.5% maximum fat and a low at less than 1%. The prime product yield is about 71% of the total weight of the cleaned corn, as compared to about 63% for the conventional milling process.

Figure 23:
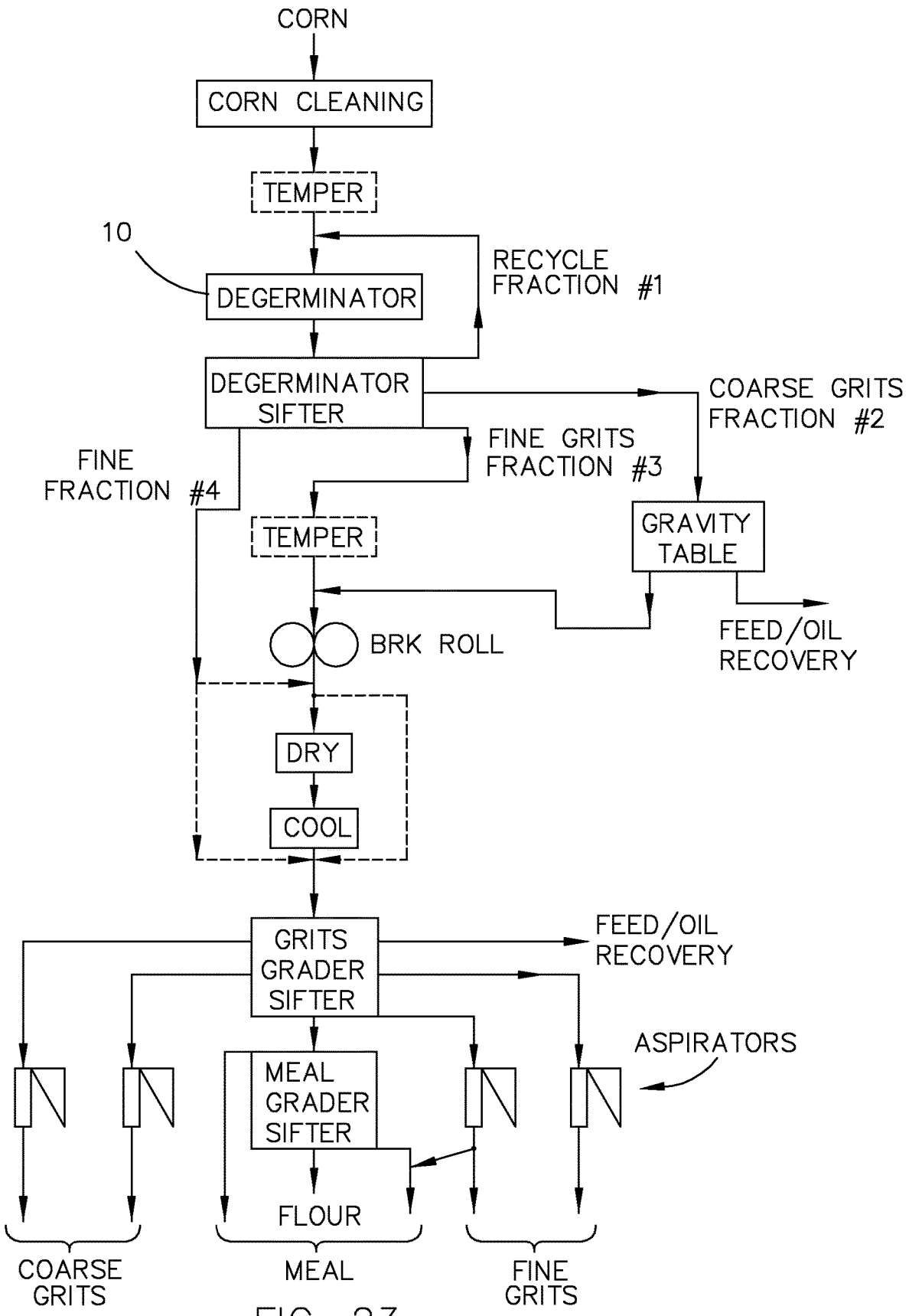
FIG. 23 is a flow diagram of a third milling process in accordance with the present disclosure.

Referring now to FIG. 23, the milling process shown therein employs tempering and the degerminator 10 described above. The object of the process is to produce a maximum yield of brewer's grits. The process of FIG. 23 is similar to that of FIG. 22, the main difference being that only one gravity table is needed and optional tempering of all or part of the grain may be carried out.

If a particularly high quantity of whole germ is desired from the degerminator or if a small amount of fines and low fat is sought, the grain is tempered after being cleaned and before degermination. Tempering at this point produces high yields and oil quality as compared to the process of FIG. 22. However, the moisture added penetrates deeply into all parts of the corn so that relatively long and extensive drying is required. A small amount of tempering is particularly beneficial if the moisture of the corn is low because in this case the degermination is enhanced appreciably due to the tempering step.

Degermination is effected by the degerminator 10 described above, and the degerminator stock is fed to a degerminator sifter which provides four fractions as in the process of FIG. 22. However, instead of directing fraction #3 to a gravity table, it is tempered, if there was no tempering previously, to bring its germ moisture content in the range of about 15% to 35%.

After tempering of the #3 fraction, it is combined with the endosperm rich grit stream from the gravity table of fraction #2, and the combined streams are then sent to fine break rolls which may be identical with those employed in the process of FIG. 22. The stream from the roller mill may be passed directly to the grits grader sifter or to a drying station and a cooling station if necessary due to marketing or end use objectives. If the grain was tempered before degermination, the fine fraction #4 is combined with the roller mill stock before drying and cooling. The fine fraction #4 from the degerminator sifter can bypass the drying and cooling stations in a situation where only fraction #3 was tempered, since fraction #4 need not be dried in this case. Fraction #4 is then combined with the roller mill stock after drying and cooling. The grits grader sifter and aspiration operations are carried out in the same manner as in the process of FIG. 22.

Minimal tempering yields results similar to and usually somewhat better than are obtained with the process of FIG. 22. More complete tempering gives results better than those of the process of FIG. 21, with yields of prime products running as high as 75% of the cleaned corn.

Figure 24:
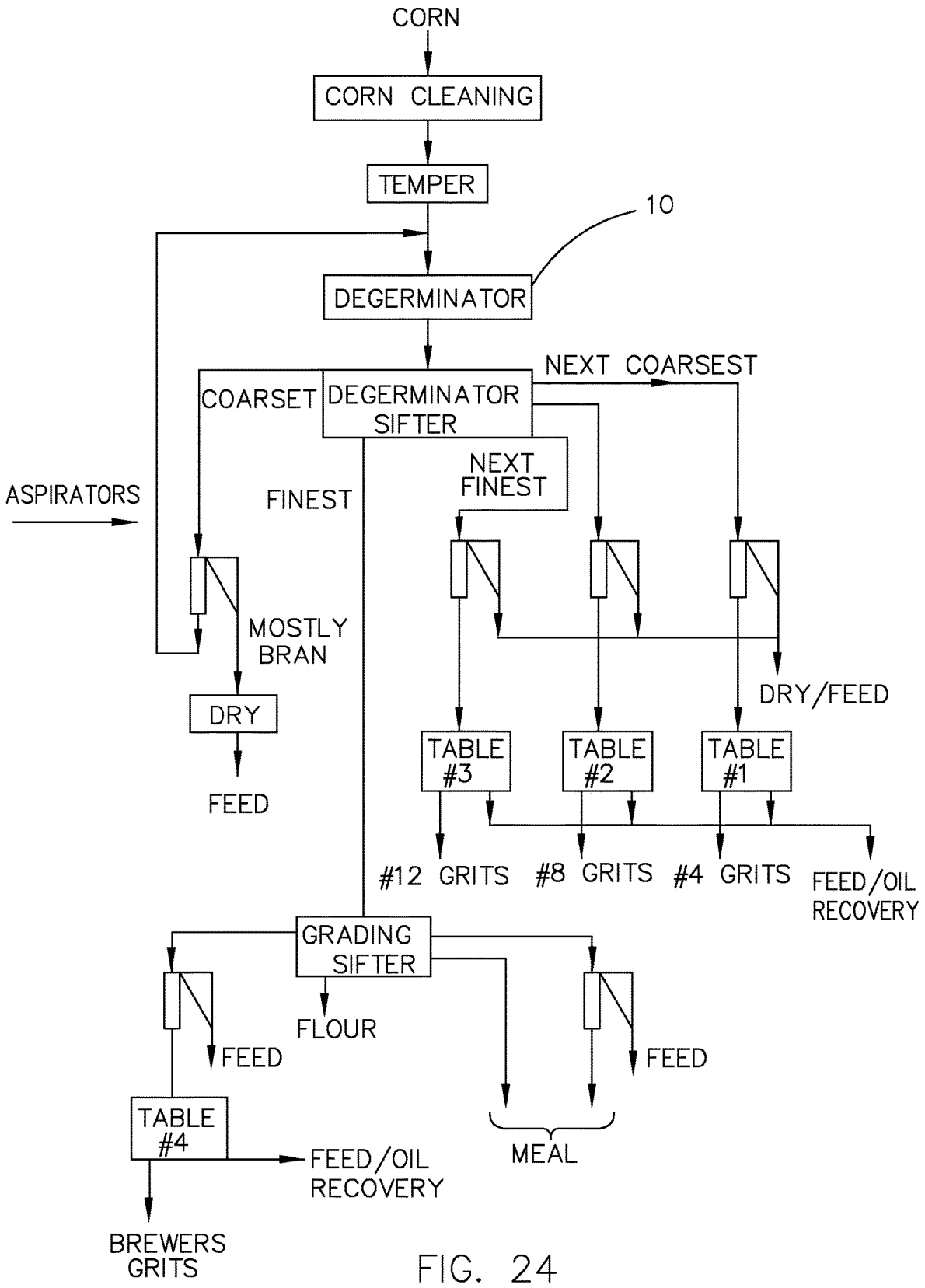
FIG. 24 is a flow diagram of a fourth milling process in accordance with the present disclosure.

FIG. 24 illustrates still another milling process in which the preferred degerminating process is used to debran as well as to degerminate. This process is used primarily to produce extra coarse grits such as those used to make cereal cornflakes in the breakfast food industry. If the objective of the process is to maximize grit size, impact deinfestation is not used to advantage in the corn cleaning operation because the broken corn that results from impact deinfestation is not debranned easily and the yield of larger grits is reduced accordingly.

After the corn is cleaned, it is tempered using water, hot water, and/or steam and is held long enough for the moisture to penetrate and loosen the bran. Unlike the conventional debranning processes which require tempering of the entire kernel, only the bran is tempered and the tempering time is reduced appreciably as a result. After tempering, the grain is degerminated by the degerminator 10 described previously, resulting in the germ being separated from the endosperm and the endosperm being crushed out of the pliable tempered bran.

The degerminator stock is sifted by the degerminator sifter wherein the top or coarsest fraction is scalped off and passed through an aspiration to remove the bran. The bran that is removed may be sent to a dryer if necessary before it is directed to animal feed or to another use. Undegerminated corn or large particles that need to be degermed and/or debranned are recycled from the aspirator back to the degerminator.

The remaining fractions from the degerminator sifter are separated according to size and according to market and/or use objectives and efficient gravity table operation. These fractions are sent to gravity tables which may be preceded by aspirators depending upon the desired efficiency of the gravity tables for separating the grain for drying or other reasons. The aspirating, sifting and gravity table operations are carried out conventionally. It has been found that for particularly efficient bran removal, most of the bran is scalped off in the recycle fraction from the degerminator sifter.

The process of FIG. 24 efficiently and economically produces extra large grits meeting the marketing specifications of fat and bran content. The fraction of extra large grits not used as grits can be reduced in size for brewer's grits and/or meal and added to the products of the degerminating process.

In each of the processes of the present disclosure, the fines from the degerminator are relatively low in fat content since the germ is maintained in a substantially whole condition. Accordingly, the fines are high enough in quality that they can remain in the prime product stock and need not be separated out and send to feed as is necessary in the conventional milling process. It is also apparent that fewer steps are required in the milling process of this disclosure as a result primarily of the high degree of degermination and debranning that is achieved in the degerminating process.

The processes illustrated in FIGS. 21-24 can be combined to produce virtually all dry corn milled products with a maximum of flexibility and economy. In addition, in situations where the desired product is cornmeal having a fat level of about 1.2% to 1.5%, even higher yields than those with lower fat products can be achieved by using size reduction equipment to break down the grits.

By virtue of the reduced number of steps required, the process of this disclosure permits the overall size of the mill to be reduced substantially. Also, the reduction in the amount of equipment provides considerable economy and decreases the maintenance and repair requirements. Since the process stock does not need to be sifted repeatedly as is necessary in the conventional gradual reduction method of milling, only a relatively small amount of sifter cloth is required. Fewer roller mills are needed, and the reduced length of the flow path correspondingly reduces the need for conveying equipment. Further economic benefits result from the reduced power requirements and the decreased need for heating, cooling and drying equipment. The simplicity of the processes has the added benefit of reducing the level of skill and training necessary to operate a mill in which the processes are carried out.

While the processes have been described with particular reference to corn milling, they find application also in connection with other grains such as wheat and grain sorghum. Manifestly, with a much smaller sized grain such as milo, rollers having finer corrugations are utilized to achieve the desired separation of components in a minimum number of steps.

The processes of this disclosure may find application for "clean up" of a stream of broken grain in a conventional milling process. It should also be apparent in connection with the process of FIG. 21 that more than one or two breaks may be made in the prebreak mill and that higher yields or higher quality products may be obtained by using three or more breaks depending upon the results desired and the nature of the grain.

By virtue of the economic benefits obtained by using the milling processes of the present disclosure, dry milling techniques may be extended into areas that have heretofore been thought to be economically impractical. For example, since yields of prime products over 70% are obtained with fat content as low as 0.4%, it is practical to apply the dry milling processes to replace the long, extensive steeping step employed in the wet milling of corn, thereby shortening the process and cutting costs. Another economic advantage of the present disclosure is the high rate of germ recovery which results in a higher oil yield per bushel of corn than is obtained with conventional dry milling processes.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A degerminator comprising:

a first base;

a first plate comprising a plurality of protrusions; and a first clamp that engages the first plate and is coupled to the first base to removably secure the first plate to the first base;

a second base;

a second plate comprising a plurality of protrusions that face the protrusions of the first plate;

a second clamp that engages the second plate and is coupled to the second base to removably secure the second plate to the second base; and an enclosure that at least partially surrounds the first plate, wherein the second base is movable between a first position, in which the second base does not engage the enclosure, and a second position, in which the second base engages the enclosure.

2. The degerminator of claim 1, wherein the first plate comprises a first edge surface, a second edge surface, and a working surface extending between the first edge surface and the second edge surface, wherein the working surface comprises the protrusions.

3. The degerminator of claim 2, wherein the first edge surface engages the first base and the second edge surface engages the first clamp.

4. The degerminator of claim 3, wherein the first base comprises a recess that receives a portion of the first edge surface.

5. The degerminator of claim 3, wherein the first edge surface and the first base engage each other in a non-vertical plane, and wherein the second edge surface and the first clamp engage each other in a non-vertical plane.

6. The degerminator of claim 2, wherein the first plate is generally annular.

7. The degerminator of claim 2, wherein no mounting holes extend through the working surface.

8. The degerminator of claim 1, wherein the first plate comprises a plurality of sections.

9. The degerminator of claim 1, further comprising a seal coupled to the second base, wherein the seal is movable between a deflated position and an inflated position, wherein the seal engages the enclosure when the seal is in the inflated position and the second base is in the second position.

10. The degerminator of claim 1, wherein the second plate comprises an inlet configured to receive corn kernels, wherein the protrusions of the first plate and the protrusions of the second plate are configured to fracture corn kernels when the second base is in the second position and the first plate rotates, and wherein the enclosure comprises an exit configured to allow fractured corn kernels to exit the enclosure.

11. The degerminator of claim 1, further comprising:

a plurality of supports each coupled to one of the first base and the second base; and a plurality of guides each coupled to one of the first base and the second base, wherein each of the guides receives one of the supports.

12. The degerminator of claim 11, further comprising a plurality of actuators each coupled to both the first base and the second base, wherein the actuators are operable to move the second base with respect to the first base.

13. The degerminator of claim 1, wherein the first plate comprises a first diameter, and further comprising a third plate comprising a second diameter that is different than the first diameter, and a third clamp that is operable to engage the third plate and couple to the first base to removably secure the third plate to the first base.

14. The degerminator of claim 1, further comprising:

a side wall that at least partially surrounds the first plate; and a removable wear ring that is at least partially positioned between the side wall and the first plate.

15. A degerminator comprising:

a first plate assembly comprising a plurality of protrusions;

an enclosure that at least partially surrounds the first plate assembly; and a second plate assembly comprising a plurality of protrusions that face the protrusions of the first plate assembly, wherein the second plate assembly further comprises a seal with a channel that is configured to receive a fluid for moving the seal between a deflated position and an inflated position, wherein the second plate assembly is movable between a first position, in which the second plate assembly does not engage the enclosure, and a second position, in which the seal engages the enclosure when the seal is in the inflated position.

16. The degerminator of claim 15, wherein the second plate assembly moves substantially vertically between the first position and the second position.

17. The degerminator of claim 15, wherein the second plate assembly comprises a base, and wherein the seal is coupled to the base adjacent a peripheral edge of the base.

18. The degerminator of claim 17, wherein the seal comprises a first surface that engages the base, wherein the seal comprises a second surface that engages the enclosure when the seal is in the inflated position and the second plate assembly is in the second position, and wherein the seal expands radially outward from the base as the seal moves from the deflated position to the inflated position.

19. The degerminator of claim 17, wherein the second plate assembly further comprises a wiper seal that is coupled to the base, wherein the wiper seal extends radially outward from the peripheral edge of the base, and wherein the wiper seal is positioned beneath the seal.

20. The degerminator of claim 15, wherein the second plate assembly comprises an inlet configured to receive corn kernels, wherein the protrusions of the first plate assembly and the protrusions of the second plate assembly are configured to fracture corn kernels when the second plate assembly is in the second position and at least a portion of the first plate assembly rotates, and wherein the enclosure comprises an exit configured to allow fractured corn kernels to exit the enclosure.

21. The degerminator of claim 15, wherein the enclosure comprises a side wall that at least partially surrounds the first plate assembly, and further comprising a removable wear ring that is at least partially positioned between the side wall and the first plate assembly.

22. A degerminator comprising:

a frame;

a first plate assembly comprising a plurality of protrusions, wherein the first plate assembly is rotatably coupled to the frame;

a second plate assembly comprising a plurality of protrusions that face the protrusions of the first plate assembly;

a plurality of supports each coupled to one of the frame and the second plate assembly;

a plurality of guides each coupled to one of the frame and the second plate assembly, wherein each of the guides receives one of the supports; and a plurality of actuators each coupled to both the frame and the second plate assembly, wherein the actuators are operable to move the second plate assembly relative to the first plate assembly.

23. The degerminator of claim 22, wherein the second plate assembly is positioned above the first plate assembly.

24. The degerminator of claim 22, wherein the actuators are operable to move the second plate assembly vertically.

25. The degerminator of claim 22, wherein each of the guides comprises a bearing, and wherein each of the supports comprises a rod.

26. The degerminator of claim 22, wherein the first plate assembly rotates around a generally vertical axis.

27. The degerminator of claim 22, wherein the frame comprises an enclosure that at least partially surrounds the first plate assembly, wherein the second plate assembly is movable between a first position, in which the second plate assembly does not engage the enclosure, and a second position, in which the second plate assembly engages the enclosure.

28. The degerminator of claim 27, wherein the second plate assembly comprises an inlet configured to receive corn kernels, wherein the protrusions of the first plate assembly and the protrusions of the second plate assembly are configured to fracture corn kernels when the second plate assembly is moved to the second position and at least a portion of the first plate assembly rotates, and wherein the enclosure comprises an exit configured to allow fractured corn kernels to exit the enclosure.

29. The degerminator of claim 27, wherein the enclosure comprises a side wall that at least partially surrounds the first plate assembly, and further comprising a removable wear ring that is at least partially positioned between the side wall and the first plate assembly.

30. A degerminator comprising:

a side wall surrounding a chamber;

a first plate comprising a plurality of protrusions, wherein the first plate is at least partially positioned within the chamber;

a second plate comprising a plurality of protrusions, wherein there is a gap between the first plate and the second plate; and a removable wear ring that is at least partially positioned between the side wall and the first plate within the chamber, wherein the removable wear ring extends from a top of the side wall to past the gap between the first plate and the second plate.

31. The degerminator of claim 30, wherein the wear ring comprises a cylindrical wall and an upper flange that extends radially outward from an upper edge of the cylindrical wall.

32. The degerminator of claim 31, wherein the side wall comprises a first diameter and the cylindrical wall comprises a second diameter that is less than the first diameter, and wherein the upper flange comprises a third diameter that is greater than the first diameter.

33. The degerminator of claim 31, wherein a top of the side wall is configured to engage and support the upper flange.

34. The degerminator of claim 30, wherein the wear ring is configured to be moved vertically upward to remove it from the chamber.

35. A degerminator comprising:

a side wall surrounding a chamber;

a plate comprising a plurality of protrusions, wherein the plate is at least partially positioned within the chamber; and a removable wear ring that is at least partially positioned between the side wall and the plate within the chamber, wherein the wear ring is configured to be moved vertically upward to remove it from the chamber.

* * * * *